US005340492A

United States Patent [19]

Kacher et al.

[11] Patent Number: 5,340,492

[45] Date of Patent: * Aug. 23, 1994

[54] SHAPED SOLID MADE WITH A RIGID, INTERLOCKING MESH OF NEUTRALIZED CARBOXYLIC ACID

[75] Inventors: Mark L. Kacher, Mason; James E. Taneri, West Chester; James B. Camden, Cincinnati; Paul E. Vest, Cincinnati; Sylvia J. Bowles, Cincinnati, all of Ohio

[73] Assignee: The Procter & Gamble Company, Cincinnati, Ohio

[ * ] Notice: The portion of the term of this patent subsequent to Jul. 6, 2010 has been disclaimed.

[21] Appl. No.: 782,956

[22] Filed: Nov. 1, 1991

Related U.S. Application Data

[63] Continuation-in-part of Ser. No. 617,827, Nov. 26, 1990, abandoned.

[51] Int. Cl.[5] ..... C11D 9/48; C11D 10/04; C11D 13/12; C11D 13/16

[52] U.S. Cl. ..... 252/112; 252/108; 252/109; 252/110; 252/111; 252/113; 252/117; 252/118; 252/121; 252/122; 252/131; 252/132; 252/134; 252/174; 252/368; 252/370; 252/554; 252/557; 252/DIG. 5; 252/DIG. 16; 252/120; 252/119

[58] Field of Search ..... 252/134, 121, 117, 120, 252/119, DIG. 16, 108, 130, 132, 131, 109, 118, 112, 110, 111, 113, 122, 174, 368, 370, 554, 557, DIG. 5, DIG. 12

[56] References Cited

U.S. PATENT DOCUMENTS

| | | | |
|---|---|---|---|
| 2,826,551 | 3/1958 | Geen | 252/89 |
| 2,988,511 | 6/1961 | Mills et al. | 252/121 |
| 2,988,551 | 6/1961 | Morren | 260/268 |
| 3,226,329 | 12/1965 | MacMillan | 252/107 |
| 3,351,558 | 11/1967 | Zimmerer | 252/137 |
| 3,557,006 | 1/1971 | Ferrara et al. | 252/117 |
| 3,835,058 | 9/1974 | White | 252/121 |
| 3,835,059 | 9/1974 | Fukuta et al. | 252/305 |
| 3,926,828 | 12/1975 | O'Neill et al. | 252/108 |
| 3,951,842 | 4/1976 | Prince et al. | 252/117 |
| 4,165,293 | 8/1979 | Gordon | 252/DIG. 16 |
| 4,396,521 | 8/1983 | Borrello | 252/DIG. 16 |
| 4,478,734 | 10/1984 | Ogino et al. | 252/117 |
| 4,606,839 | 8/1986 | Harding | 252/132 |
| 4,666,624 | 5/1987 | Irlam et al. | 252/134 |
| 4,673,525 | 6/1987 | Small et al. | 252/132 |
| 4,704,223 | 11/1987 | Gupta et al. | 252/132 |
| 4,758,370 | 7/1988 | Jungermann et al. | 252/108 X |
| 4,954,282 | 9/1990 | Rys et al. | 252/117 |
| 4,963,284 | 10/1990 | Novakovic et al. | 252/121 |
| 5,076,953 | 12/1991 | Jordan et al. | 252/108 |
| 5,093,112 | 3/1992 | Birtwistle et al. | 252/DIG. 16 |
| 5,225,097 | 7/1993 | Kacher et al. | 252/112 |
| 5,225,098 | 7/1993 | Kacher et al. | 252/112 |
| 5,227,086 | 7/1993 | Kacher et al. | 252/112 |
| 5,262,079 | 11/1993 | Kacher et al. | 252/112 |

FOREIGN PATENT DOCUMENTS

| | | |
|---|---|---|
| 2132035 | 1/1973 | Fed. Rep. of Germany . |
| 57-61800 | 12/1982 | Japan . |
| 60-23156 | 6/1985 | Japan . |
| 513696 | 10/1938 | United Kingdom . |
| 2114145 | 8/1983 | United Kingdom . |

OTHER PUBLICATIONS

Journal of American Chemical Society 1940 (vol. 63, pp. 1990–1993) by L. Marton et al. "An Electron Microscope Study of Curd Fibers of Sodium Laurate".

*Primary Examiner*—Dennis Albrecht
*Assistant Examiner*—Douglas J. McGinty
*Attorney, Agent, or Firm*—Leonard Williamson

[57] ABSTRACT

The invention provides a shaped solid, three-dimensional skeleton structure comprising: a relatively rigid, interlocking mesh of neutralized crystalline carboxylic acid. In another respect, the present invention provides an improved cleansing bar which is comprised of the rigid, interlocking mesh of neutralized carboxylic acid, preferably sodium soap fibers. Such preferred cleansing bars can be formulated to have essentially no bar smear. Some cleansing bars comprise surprisingly large amounts of water and other liquids while maintaining their rigidity and excellent smear properties; even when allowed to soak overnight in water.

21 Claims, 7 Drawing Sheets

HIGH MOISTURE BARS
SCANNING ELECTRON MICROSCOPY
5%Na La LAURATE/94% WATER BAR (RECRYSTALLIZED)

5000X

2500X

HIGH MOISTURE BARS
SCANNING ELECTRON MICROSCOPY
25% Na La LAURATE/74% WATER BAR

SURFACE VOID
3000X

SURFACE
5000X

5000X

20% DISODIUM SALT OF 1,12
DODECANEDOIC ACID/ 80% WATER

2000X

33%LITHIUM MYRISTATE/
5% LITHIUM CHLORIDE/
62% WATER

1500X

EXAMPLE 1

1500X

IVORY

1000X

NEUTROGENA

1500X

SHAPED SOLID MADE WITH A RIGID, INTERLOCKING MESH OF NEUTRALIZED CARBOXYLIC ACID

CROSS-REFERENCE TO RELATED APPLICATION

This is a continuation-in-part application of U.S. Ser. No. 07/617,827, filed Nov. 26, 1990, abandoned.

TECHNICAL FIELD

This invention relates to neutralized carboxylic acid shaped solid compositions, particularly cleansing bars, cakes, soap bars, synbars and the like.

BACKGROUND

Products made in the form of shaped solids, cakes and bars are numerous. Cleansing bars are well known in the art.

Cleansing bars with reduced bar smear are reported in the art. E.g., U.S. Pat. No. 2,988,511, Mills, issued Jun. 13, 1961, incorporated herein by reference, discloses a low smearing bar.

Bar smear, also referred to as bar sloth, is the soft solid or mush that forms at the surface of a bar when submerged in water and is regarded by consumers as messy, unattractive, and uneconomical.

Products made in the form of shaped solids, cakes and bars are numerous. E.g., certain high moisture and low smear personal cleansing bars are disclosed in U.S. Pat. No. 4,606,839 Harding, issued Aug. 19, 1986. Harding uses coconut and/or palm kernel oil soap.

One only has to examine a used personal cleansing bars in their bathroom to see that there is still a need for improved cleansing bars with little or no smear.

The formation of rigid, soap curd fibers of sodium laurate is reported by L. Marton et al. in a 1940 Journal of American Chemical Society (Vol. 63, pp. 1990–1993). The report does not teach a utility for the soap curd. Shaped solids, as defined herein, are not disclosed by Marton et al.

Japanese Pat. J5 7030-798, Jul. 30, 1980, discloses transparent solid framed or molded soap bar in which fatty acids constituting the soap component are myristic, palmitic, and stearic acids. A transparent soap is described in which at least 90 wt. % of the fatty acids which constitute the soap component are myristic acid, palmitic acid, and stearic acid. The product is reported as a transparent, solid soap having good frothing and solidifying properties, good storage stability, and a low irritant effect on human skin. The process and transparent bar soap composition exemplified in Jap. J5 7030-798 do not appear to contain synthetic surfactant.

It is also difficult to produce firm, non-sticky bars that contain relatively high levels (15–40%) of moisture (especially in the presence of most synthetic surfactants), hygroscopic surfactants and/or higher levels of non-solids and soft solids, such as water-soluble polyols and hydrocarbon greases.

SUMMARY OF THE INVENTION

The invention provides a shaped, solid three-dimensional skeleton structure comprising: a relatively rigid, interlocking mesh of neutralized crystalline carboxylic acid. In another respect, the present invention provides an improved cleansing bar which is comprised of said skeleton structure, i.e., the rigid, interlocking mesh of neutralized carboxylic acid, preferably sodium soap fibers. Some cleansing bars which comprise surprisingly large amounts of water and other liquids while maintaining their rigidity and excellent smear properties; even when allowed to soak overnight in water.

DETAILED DESCRIPTION OF FIGURES

The Scanning Electron Microscopy (SEM) sample preparation involves fracturing a shaped solid with simple pressure to obtain a fresh surface for examination. The fractured sample is reduced in size (razor blade) to approximately a 10 mm×15 mm rectangle with a thickness of about 5 mm. The sample is mounted on an aluminum SEM stub using silver paint adhesive. The mounted sample is coated with approximately 300 angstroms of gold/palladium in a Pelco sputter coater. Prior to coating, the sample is subjected to vacuum for a period of time which is sufficient to allow sufficient loss of bar moisture assuring acceptable coating quality. After coating, the sample is transferred to the SEM chamber and examined under standard SEM operating conditions with an Hitachi Model S570 Scanning Electron Microscope in order to see the skeletal (core) frame.

Figure 1:
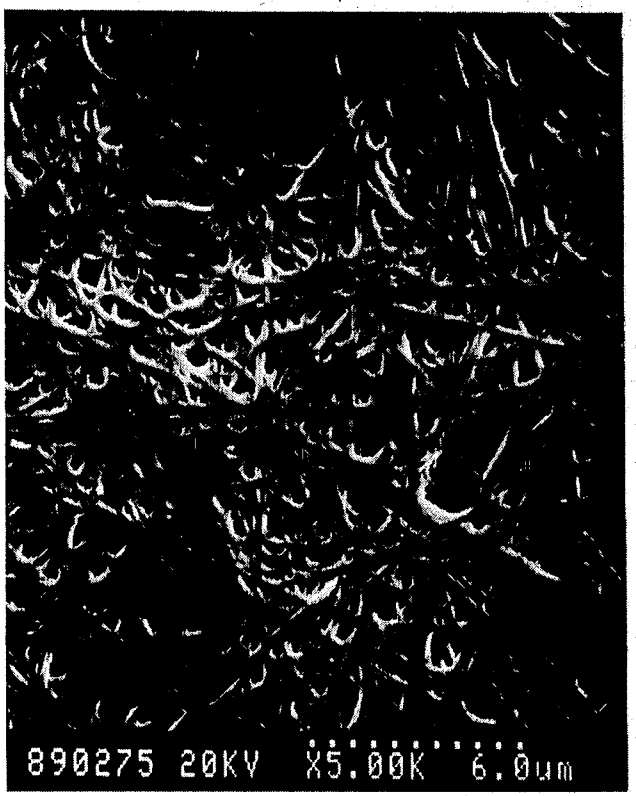
FIGS. 1–8 show magnified views of bar samples of the present invention.
Figure 2:
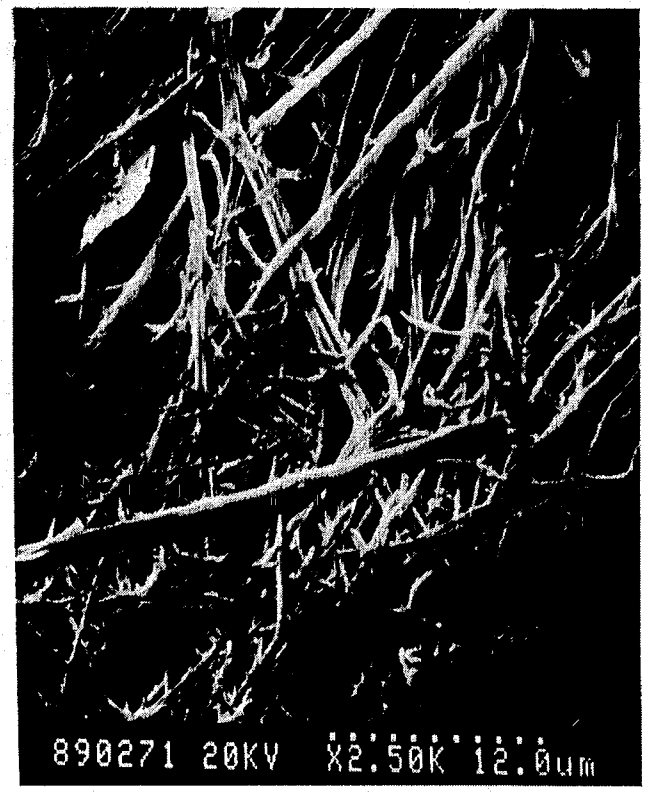

FIGS. 1 and 2 are copies of photographs of a highly enlarged skeleton core structure comprising a rigid, interlocking mesh of elongated neutralized carboxylic acid crystalline fibers. More specifically FIGS. 1 and 2 are elongated $C_{12}$ sodium soap fibers, enlarged respectively at 5000X and 2500X magnifications. The structure of FIGS. 1 and 2 are made with 5% soap; 94% water; and 1% sodium chloride. See Example 10 in Table 7 herein. Note that larger fibers in the interlocking mesh can be composed of smaller fibers. Also, note the "void" spaces. See FIG. 2.

Figure 3:
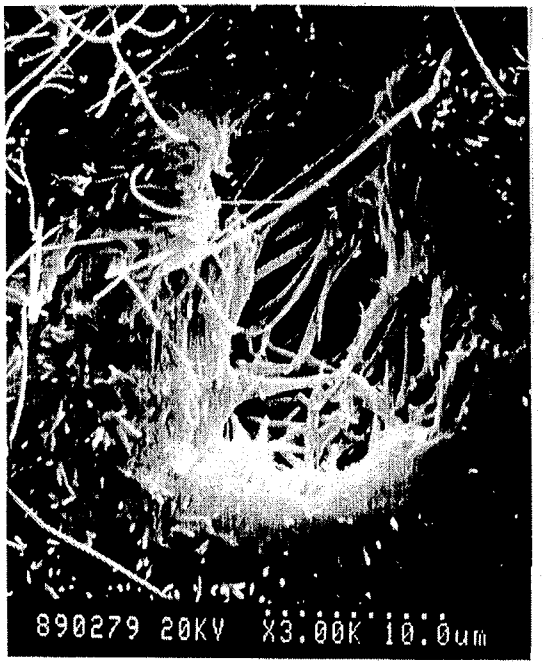
Figure 4:
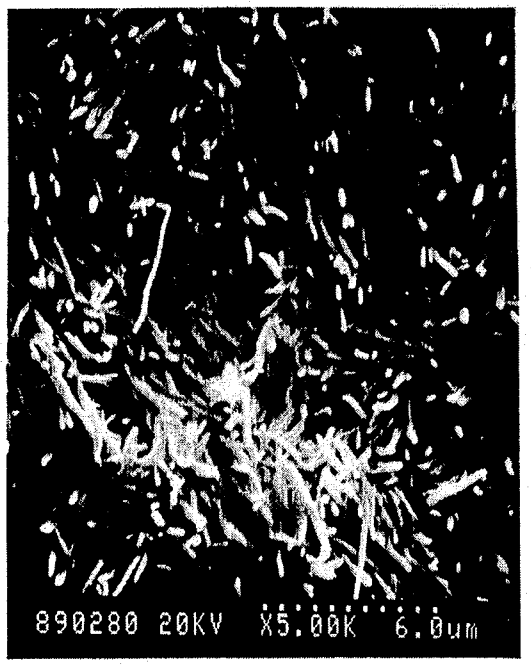
Figure 5:
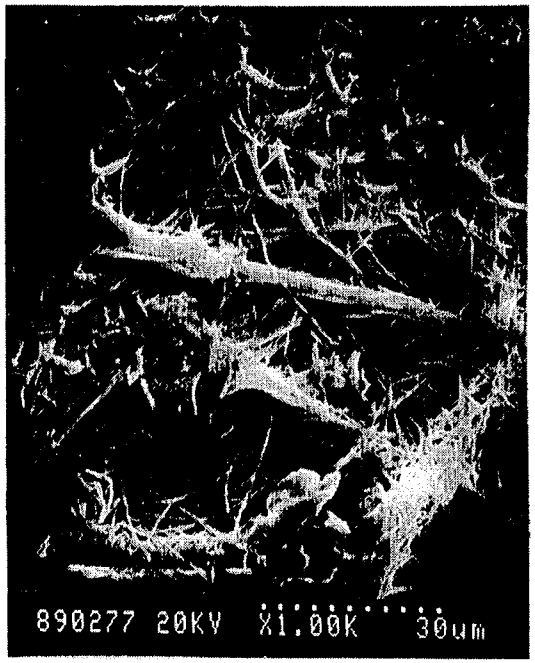

FIGS. 3, 4 and 5 are copies of photographs of a skeleton structure made with 25% sodium $C_{12}$ soap; 74% water; and 1% sodium chloride. The crystalline fiber-like structure is shown respectively at 3000X, 5000X and 1000X magnifications.

Figure 6:
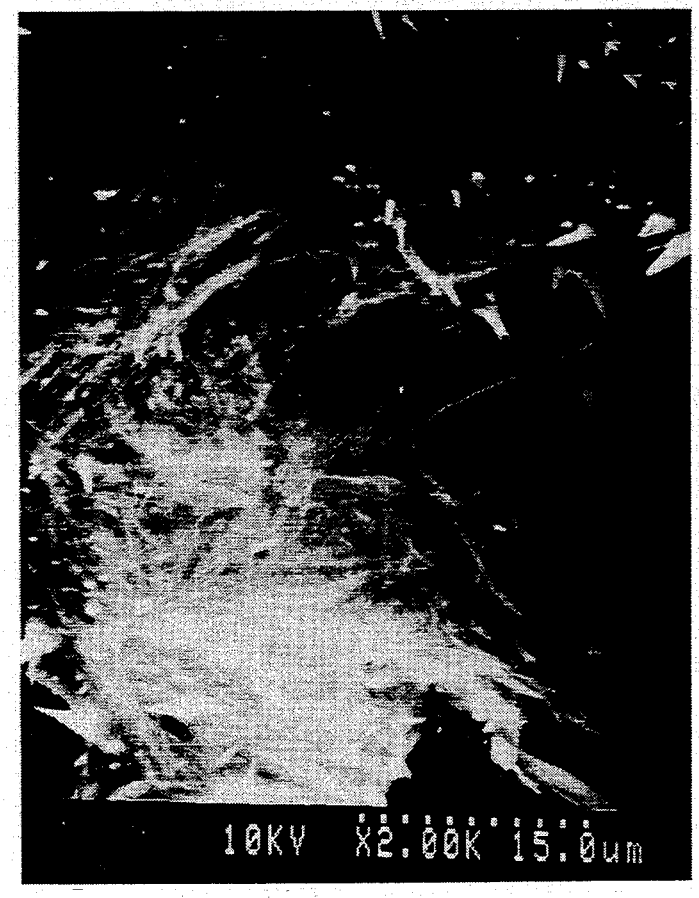

FIG. 6 is a copy of a photograph of a skeleton structure made with 20% disodium salt of 1,12-dodecanedioic acid. The crystalline fiber-like structure is shown at 2000X magnification. See Example 26.

Figure 7:
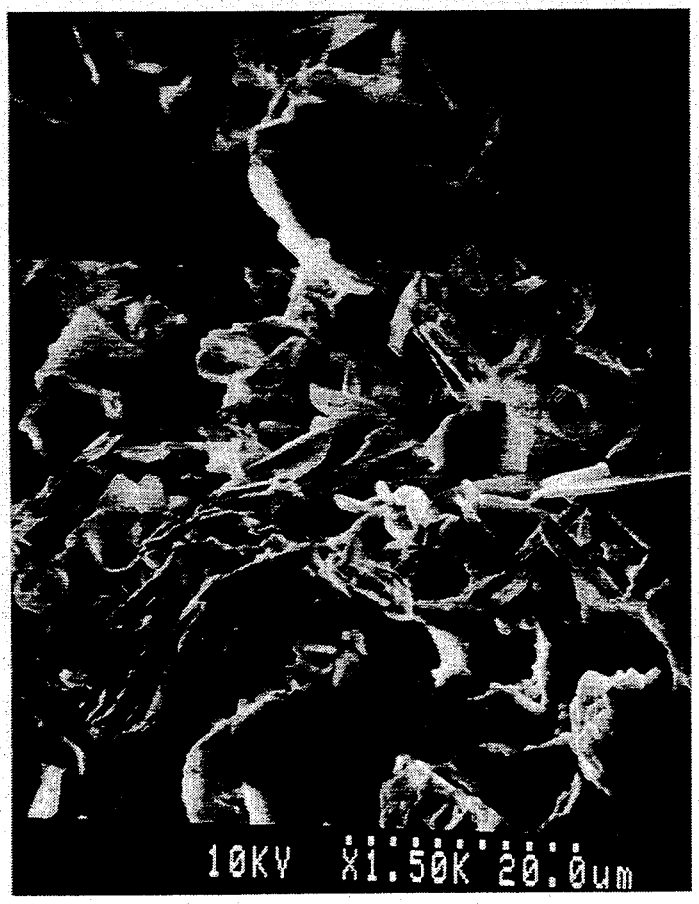

FIG. 7 is a copy of a photograph of a skeleton (core) structure comprising crystalline lithium neutralized $C_{14}$ carboxylic acid mesh, shown at 1500X magnification. See Example 27.

Figure 8:
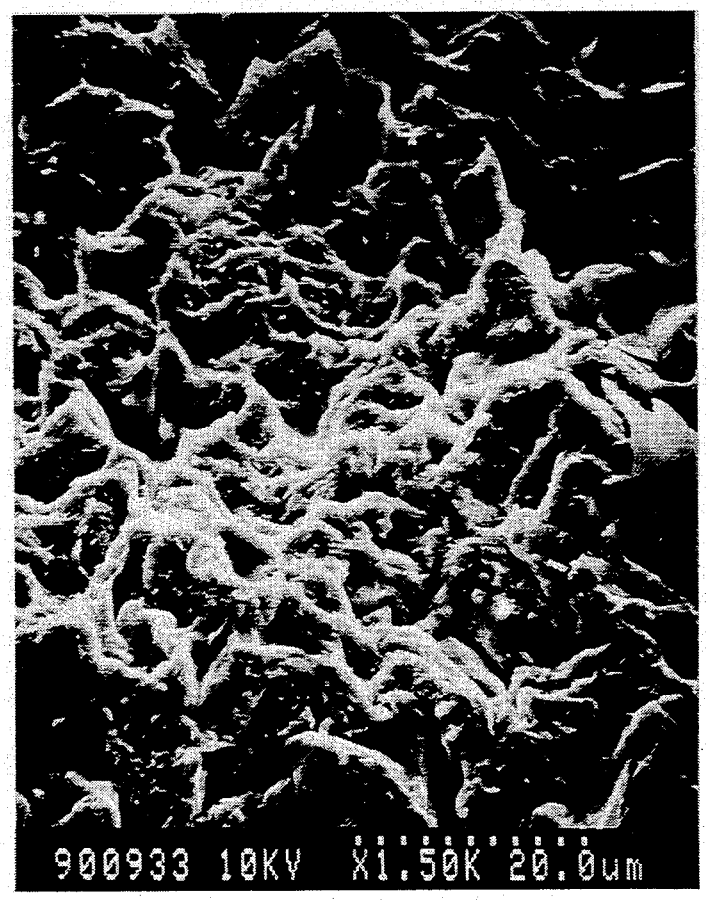

FIG. 8 is a copy of a photograph of a cleansing bar (Example 1 hereinbelow) comprising: coated $C_{14-16}$ sodium soap fibers. The fibers are coated and/or commingled with the other bar components. The magnification is 1500X.

Figure 9:
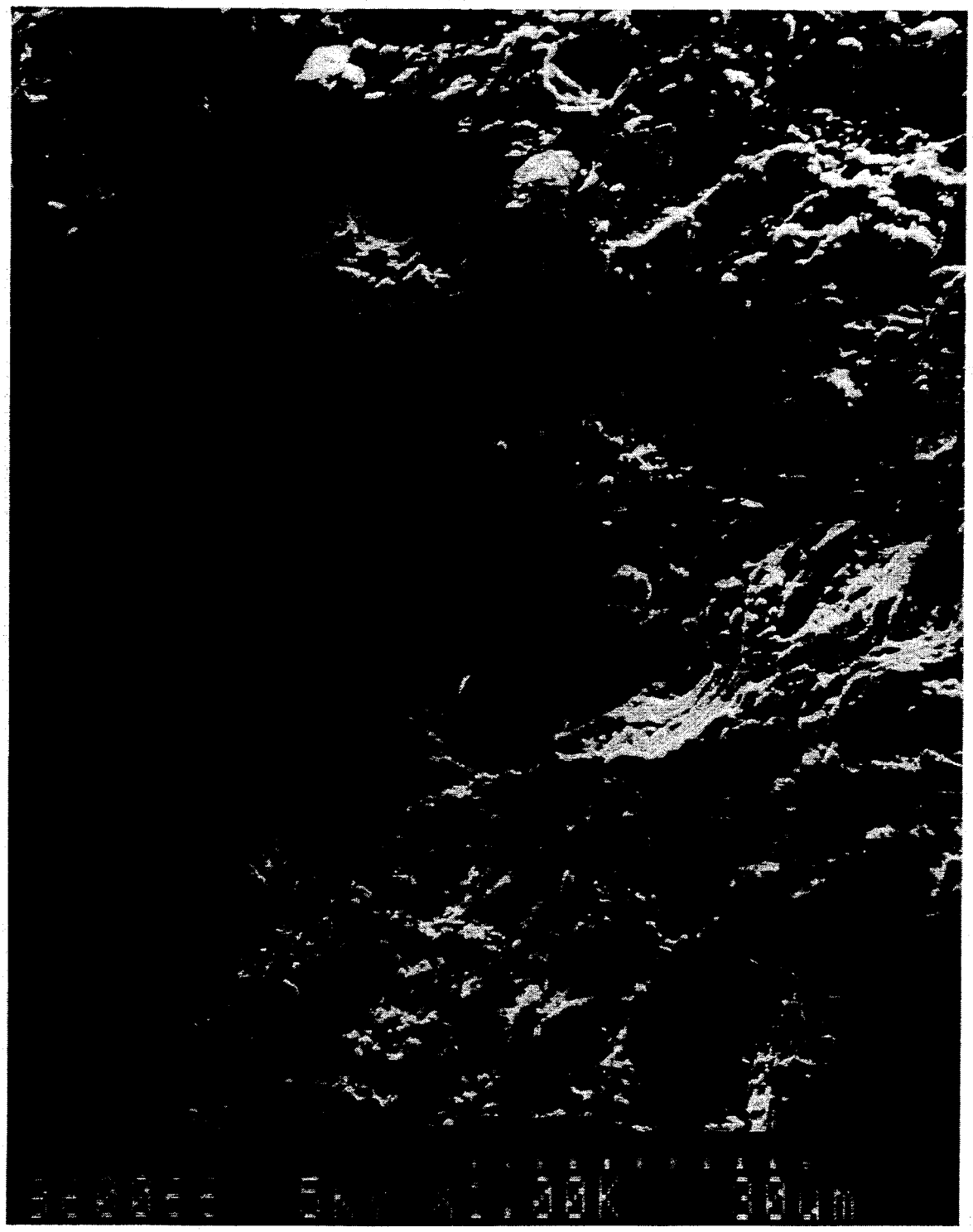
FIGS. 9 and 10 show magnified views of two different conventional soap bars.

FIG. 9 shows a sample of a market IVORY ® freezer bar made with sodium/potassium coconut/tallow soap at 1000X on the scale. The air in the IVORY bar soap makes it float.

Figure 10:
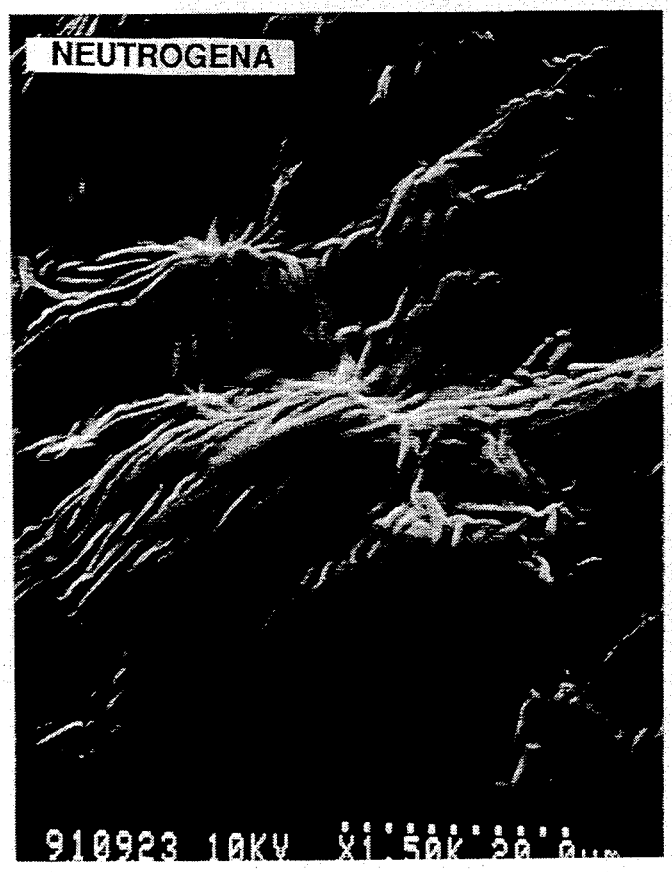

FIG. 10 shows a sample of a market NEUTROGENA ® transparent bar at 1500X.

In FIGS. 1 and 2, the samples are first melted on a hot plate and recooled on a glass slide. The other samples, FIGS. 3–10, are samples of original shaped solid structures or the conventional bar prepared as set out herein.

DETAILED DESCRIPTION OF THE INVENTION

The invention provides a shaped solid comprising two or more phases. One phase is a crystalline skeleton structure comprising a rigid interlocking, open, three-dimensional mesh of neutralized carboxylic acid elongated crystals. The other essential phase is an aqueous phase which is soft or flowable at 25° C.

More specifically, the skeleton structure is a relatively rigid, interlocking, open, three-dimensional mesh of neutralized mono- and/or di-carboxylic acid elongated crystals.

The terms: skeleton structure, skeletal structure, core, and skeleton frame are often used interchangeably herein.

The term "shaped solid" as used herein includes forms such as bars, cakes and the like. The term "bar" as used herein includes the same unless otherwise specified.

The term "mesh" as used herein means an interlocking crystalline skeleton network with voids or openings when viewed under magnification by scanning electron microscopy.

In another respect, the present invention provides an improved cleansing bar which is comprised of said skeleton structure. Some shaped solids are in the form of cleansing bars which contain surprisingly high levels of said aqueous phase comprising water, other liquids and soft materials. Notwithstanding the presence of relatively large levels of an aqueous phase, the preferred bars of the present invention maintain their rigidity and excellent smear properties, even when allowed to soak overnight in water. While not being bound to any theory, the shaped solid comprising these phases is similar to a relatively rigid wet sponge.

The crystalline phase comprises crystals in the form of either interlocking platelets and/or fibers, preferably fibers. Preferably said fibers are composed of sodium soap. The interlocking mesh of said fibers and/or platelets imparts strength to the three-dimensional structure, even in the presence of relatively high levels of water or other soft materials; even when allowed to soak overnight in water.

The strength of the skeleton structure can be measured indirectly by the hardness of the shaped solid, as determined by the resistance to penetration of the solid using a Standard Weighted Penetrometer Probe. See Bar Harness Test below for more details. The skeleton structure is of sufficient rigidity that a 20 mm thick or greater cleansing bar sample has a penetration of from about zero mm to about 12 mm, preferably from about 1 mm to about 10 mm, more preferably from about 3 mm to about 8 mm.

The present bars are distinguished from conventional transparent bars based on crystal size, as well as other characteristics. The crystals or crystal bundles that make-up the interlocking mesh structure of the present invention preferably are of a size that diffracts light and consequently are greater than 400 nm in either diameter or length. On the other hand, conventional transparent bars gain their transparency by having crystal diameters or length less than the wavelength of white light, which is greater than about 400 nm and consequently do not diffract light.

Once formed, a bar (shaped solid) comprising the rigid skeletal structure of the present invention loses its rigidity when subjected to fracturing mechanical forces, e.g., those used in a conventional plodded bar making process as disclosed in U.S. Pat. Nos. 4,812,253, Small or 4,820,447, to Medcalf. This is because the fracturing mechanical forces shear and break up the rigid, skeletal structure into smaller pieces. Thus, when a bar of the present invention is sheared in a plodder, a much softer bar results.

On the other hand, when a finished conventional bar is plodded or replodded, the replodded conventional bar is still very hard. See Example 28 and Table 12 for more details on this point.

The skeletal structure contains substantial "void" areas which are filled by soft and/or liquid aqueous phases. It is a surprising aspect of this invention that the physical properties of the bar, such as bar hardness and little smear, are mostly dependent on the crystalline interlocking mesh structure, even when the other phases make up a majority of the materials present. In conventional bars, many components can impact the overall bar physical properties because the components either modify the phase and structure of the soap or synthetic surfactant components that primarily determine the bar's physical properties. The combination of two or more phases (e.g., soap and aqueous solution) drastically changes the colloidal structure, and consequently, the physical properties of a conventional bar.

Thus, conventional bars are more limited in the type, levels and composition of soft phase materials that can be incorporated into the bar than the present invention. Such phases include most materials that are either flowable liquids or materials that are softer than the minimum hardness of an acceptable bar. These phases include aqueous solutions, liquid crystalline phases composed of water and surfactant, polymers; particularly surfactant-containing crystalline phases, and especially hygroscopic surfactants, which tend to become soft and sticky when mixed with water or other liquid phases including water-soluble organics (e.g., propylene glycol and glycerine), hydrophobic materials (e.g., mineral oil, liquid triglycerides), or soft hydrophobic materials, e.g., petrolatum, low melting paraffin, and low melting triglycerides.

In physical terms, all these phases can be characterized as being flowable liquids or so soft that a Standard Weighted Penetrometer Probe, as defined herein, will penetrate all the way through a 12 mm thick sample. These phases can be selectively included in the structure of the present invention without loss of the interlocking mesh structure and certain desirable physical properties.

DESCRIPTION OF PREFERRED EMBODIMENTS

The invention is a shaped solid comprising a skeleton structure that is a relatively rigid interlocking, open three-dimensional mesh of neutralized mono- and/or di-carboxylic acid elongated crystals.

The preferred embodiment is a cleansing bar comprising at least two phases: (1) an aqueous phase having a penetration value of about 12 mm for a 12 mm deep sample; said aqueous phase being soft or flowable; (2) a rigid crystalline phase comprising a rigid crystalline phase skeleton structure comprising an interlocking, open three-dimensional mesh of neutralized mono- and/or di-carboxylic acid elongated crystals; wherein said cleansing bar comprising said rigid crystalline phase skeleton structure and said aqueous phase has a penetration value of of from zero to about 12 mm for a 25 mm deep sample; and wherein said penetration values are measured as 25° C. using a 247 gram Standard Weighted Penetrometer Probe having a conical needle attach to a 9 inch (22.9 cm) shaft weighing 47 grams, with 200 grams on top of said shaft for a total of said 247 grams, said conical needle having a 19/32 inch (1.51 cm) top and a 1/32 inch (0.08 cm) point.

The above cleansing bar is preferred when said neutralized carboxylic acid is selected from the group consisting of: lithium and/or sodium neutralized: monocarboxylic acid (soap) and/or dicarboxylic acid; and mixtures thereof; wherein said monocarboxylic acid has a fatty alkyl(ene) chain of from about 12 to about 24 carbon atoms; wherein said dicarboxylic acid has a fatty alkyl(ene) chain of from about 12 to about 18 carbon atoms; and wherein at least about 80% of said carboxylic acid has saturated alkyl(ene) chains; and wherein said rigid crystalline phase skeleton structure occupies from about above 3% to about 75% of said cleansing bar by volume; and wherein said neutralized carboxylic acid comprises from about above 5% to about 75%; and wherein said cleansing bar contains from about 15% to about less than 94% water by weight of said cleansing bar.

The above cleansing bar is preferred when at least 80%, preferably 90%, of the carboxylic acid has the following general formula:

$$H-(CH_2)_a-\underset{\underset{X}{|}}{CH}-(CH_2)_b-CO_2-M^+$$

wherein:

$a + b = 8$ to 20
each a, b = 0 to 20

$X = H, OR, O-\overset{\overset{O}{\|}}{C}-R, R$, or mixtures thereof $R = C_1-C_3$ alkyl, H, or mixtures thereof
M = Na, Li, or mixtures thereof.

The above cleansing bar is more preferred when said a+b=10–16; each of said a, b=0–16; said X=H, OR; R=H; and M=Na.

The above cleansing bar is highly preferred when said elongated crystals are composed of fiber-like sodium fatty acid soap of which at least about 25% of said saturated fatty alkyl chains is of a single chain length; and wherein said bar contains: from about 15% to about 75% of said sodium soap; wherein the ratio of said unneutralized (free) carboxylic acid to soap is from about 1:2 to about 0. In other words, the free fatty acid is no more than 50% by weight of the soap in the formulation.

The above cleansing bar is preferred when said bar contains said sodium soap and water; and from about 2% to about 60% of a synthetic surfactant selected from the group consisting of: alkyl sulfates, paraffin sulfonates, alkylglycerylether sulfonates, acyl sarcosinates, methylacyl taurates, linear alkyl benzene sulfonates, N-acyl glutamates, alkyl glucosides, alpha sulfo fatty acid esters, acyl isethionates, alkyl sulfosuccinates, alkyl ether carboxylates, alkyl phosphate esters, ethoxylated alkyl phosphate esters, methyl glucose esters, protein condensates, alkyl amine oxides, alkyl betaines, alkyl sultaines, the alkyl ether sulfates with 1 to 12 ethoxy groups, and mixtures thereof, wherein said surfactants contain $C_8-C_{22}$ alkyl chains.

The above cleansing bar is preferred when said synthetic surfactant is hygroscopic; said hygroscopic surfactant being defined as a surfactant which absorbs at least 20% of its dry weight in water at 26° C. and 80% Relative Humidity in three days and wherein said bar is relatively non-swelling.

The above cleansing bar is preferred when said hygroscopic surfactant is selected from the group consisting of alpha sulfo fatty acid esters; alkyl sulfates; alkyl ether carboxylates; alkyl betaines; alkyl sultaines; alkyl amine oxides; alkyl ether sulfates; and mixtures thereof.

The above cleansing bar is preferred when the ratio of said water to said soap is from about 1:1 to about 5:1; said water is present at a level of from about 25% to about 60%; wherein said fatty alkyl chains are $C_{14}$ to $C_{22}$ and said soap level in said bar is from about 15% to about 35%; wherein at least about 85% of said alkyl chains are saturated; wherein the weight ratio of said unneutralized {free) carboxylic acid to said soap is from about 1:4 to 0; and wherein said synthetic surfactant level is from about 4% to about 25% by weight of the bar and said surfactant is selected from the group consisting of: sodium acyl isethionates, sodium acyl sarcosinates, sodium alpha sulfo fatty acid esters, sodium paraffin sulfonates, sodium alkyl ether sulfates, sodium alkyl sulfates, sodium linear alkyl benzene sulfonates, alkyl betaines, alkyl sultaines, and trialkyl amine oxides.

The above cleansing bar is preferred when the ratio of said water to soap ratio is from about 1.5:1 to about 2:1; the ratio of said unneutralized (free) carboxylic acid to said soap is from about 1:6 to 0; said water level is from about 30% to about 45%; said fatty alkyl chain is from about $C_{14}$ to about $C_{18}$; wherein at least about 95% of said alkyl chains are saturated; said soap level is from about 15% to about 30%; and said synthetic surfactant level is from about 8% to about 16%. The above ratio of 1:6 to 0 means about 17% of free carboxylic acid by weight of the soap to all soap.

The above cleansing bar is preferred when said bar contains from about 0.1% to about 40% of a hydrophobic material selected from the group consisting of: microcrystalline wax, petrolatum, carnauba wax, palm wax, candelilla wax, sugarcane wax, vegetable derived triglycerides, beeswax, spemaceti, lanolin, wood wax, shellac wax, animal derived triglycerides, montar, ozokerite, ceresin, and Fischer-Tropsch wax.

The above cleansing bar is preferred when said bar contains from about 2% to about 35% of said hydrophobic material selected from the group consisting of petrolatum and wax, said petrolatum and wax, and mixtures thereof melting melting about 49° C. (120° F.) to about 85° C. (185° F.).

The above cleansing bar is preferred when said bar comprises from about 5% to about 25% by weight of the bar of paraffin wax.

The above cleansing bar is preferred when said bar contains from about 1% to about 50% of a non-volatile, water-soluble, nonionic organic material having a solubility of at least 5 parts in 10 parts of water; and wherein said water-soluble nonionic organic material is selected from the group consisting of a polyol of the structure:

$$R_1-O(CH_2-\underset{\underset{R_2}{|}}{CHO})_nH$$

where $R_1$=H, $C_1$–$C_4$; $R_2$=H, $CH_3$; and n=1–200; $C_2$–$C_{10}$ alkane diols; sorbitol; glycerine; sugars; sugar derivatives; urea; and ethanol amines of the general structure $(HOCH_2CH_2)_xNH_y$ where x=1–3; y=0–2; and x+y=3, and mixtures thereof.

The above cleansing bar is preferred when said bar contains from about 2% to about 40% of said non-volatile, water-soluble, nonionic organic material.

The above cleansing bar is preferred when said non-volatile, water-soluble, nonionic organic material comprises from about 5% to about 20% by weight of the bar; and wherein said organic material is selected from the group consisting of: propylene glycol, glycerine, sucrose, and urea, and mixtures thereof.

The above cleansing bar is preferred when said bar contains said sodium soap, said water, and said synthetic surfactant, and from about 0.1% to about 70% of other ingredients selected from the group consisting of:

from about 1% to about 10% said potassium soap;

from about 1% to about 35% said magnesium soap;

from about 1% to about 35% said calcium soap;

from about 1% to about 15% triethanolammonium soap;

from about 1% to about 60% of impalpable water-insoluble materials selected from the group consisting of calcium carbonate and talc;

from about 0.1% to about 20% of a polymeric skin feel aid; wherein said polymeric skin feel aid is selected from the group consisting of cationic polysaccharides, preferably cationic guar gum with molecular weights of 1,000 to 3,000,000; cationic polyalkylene imines, ethoxypolyalkylene imines, and poly[N-[-3-(dimethylammonio)propyl]-N'-[3-ethyleneoxyethylene dimethylammonio)propyl-]urea dichloride]; silicone gum; and silicone fluids; JR polymers; Celquat ®;

from about 0.5% to about 25% of aluminosilicate clay and/or other clays; wherein said aluminosilicates and clays are selected from the group consisting of zeolites; kaolin, kaolinite, montmorillonite, attapulgite, illite, bentonite, halloysite, and calcined clays;

from about 1% to about 50% of salt and salt hydrates; and mixtures thereof; and wherein said salt and salt hydrate have a cation selected from the group consisting of: sodium, potassium, magnesium, calcium, aluminum, lithium, ammonium, monoethanol ammonium, di ethanol ammonium, and triethanolammonium; and wherein said salt and salt hydrate have an anion selected from the group consisting of: chloride, bromide, sulfate, metasilicate, orthophosphate, pyrophosphate, polyphosphate, metaborate, tetraborate, carbonate, bicarbonate, hydrogen phosphate, methyl sulfate, and mono- and polycarboxylate of 6 carbon atoms or less.

The above cleansing bar is preferred when said elongated crystals contain platelets and wherein said soap consists of lithium neutralized monocarboxylic acid.

The above cleansing bar is preferred when said elongated crystals are fiber-like and wherein said neutralized dicarboxylic acid is the disodium salt 1,12-dodecanedioic acid and wherein said neutralized dicarboxylic acid comprises from about 20% to about 70% by weight of said bar.

A Preferred Process for Making the Bar

A process of making the above preferred cleansing bar of the present invention comprises the steps of:

I. forming an aqueous molten liquid comprising about 15% to about 94% water and from about 6% to about 75% by weight said neutralized carboxylic acid;

II. pouring said molten liquid into a bar shaped mold; and

III. crystallizing said molded molten liquid by cooling to provide said cleansing bar.

The above process is preferred when the aqueous molten liquid is made by neutralizing an aqueous mixture of said carboxylic acid with sodium hydroxide or lithium hydroxide with stirring at a temperature of from about 50° C. (120° F.) to about 95° C. (205° F.).

The above process is preferred when from about 2% to about 15% by weight of said bar is a "crystallization enhancing salt" selected from the group consisting of: sodium or lithium salt of sulfate, chloride, acetate and citrate, and mixtures thereof.

The above process is preferred when said aqueous molten liquid aqueous phase contains from about 2% to about 40% of a solubilizing aid selected from the group consisting of:

(a) non-volatile, water-soluble nonionic organic solvents selected from the group consisting of: a polyol of the structure:

$$R_1-O(CH_2-\underset{\underset{R_2}{|}}{CH}O)_nH$$

where $R_1$=H, $C_1$–$C_4$; $R_2$=H, $CH_3$; and n=1–200; $C_2$–$C_{10}$ alkane diols; sorbitol; glycerine; sugars; sugar derivatives; urea; and ethanol amines of the general structure $(HOCH_2CH_2)_xNH_y$ where x=1=3; y=0–2; and x+y=3;

(b) alcohols of from 1 to 5 carbon atoms;

(c) synthetic surfactant selected from the group consisting of: alkyl sulfates, paraffin sulfonates, alkyl glyceryl ether sulfonates, anionic acyl sarcosinates, methyl acyl taurates, linear alkyl benzene sulfonates, N-acyl glutamates, alkyl glucosides, alpha sulfo fatty acid esters, acyl isethionates, alkyl sulfosuccinates, alkyl ether carboxylates, alkyl phosphate esters, ethoxylated alkyl phosphate esters, methyl glucose esters, protein condensates, alkyl amine oxides, alkyl betaines, alkyl sultaines, the alkyl ether sulfates with 1 to 12 ethoxy groups, and mixtures thereof, wherein said surfactants contain $C_8$–$C_{22}$ alkylene chains; and mixtures thereof; and wherein said solubilizing aid is added to increase the level of said neutralized carboxylic acid dissolved in said continuous molten aqueous phase in step I.

The above process is preferred when said aqueous phase contains from about 20% to about 100% water by weight of said aqueous phase.

The above process is preferred when said rigid crystalline phase contains from about 75% to about 100% of said neutralized carboxylic acid by weight of said crystalline phase.

The above process is preferred when said bar has a penetration value of from about 3 mm to about 9 mm for said 25 mm bar sample.

The above process is preferred when said bar has miscellaneous non-carboxylic acid phases comprising droplets or crystals selected from waxes, petrolatum, clays, and the like.

A highly preferred embodiment of the present invention is: a personal cleansing bar composition comprising a rigid, crystalline interlocking mesh of elongated sodium soap crystals; said soap bar comprising: from about 15% to about 50% sodium fatty acid soap composed of at least about 50% saturated fatty alkylene chains having 12–24 carbon atoms of which at least about 25% of said saturated fatty alkyl chains is of a single chain length; from about 15% to about 60% water; and from about 2% to about 60% by weight of a hygroscopic synthetic surfactant wherein said hygroscopic synthetic surfactant is selected from surfactants which absorb at least about 20% of their dry weight in water at 26° C. and 80% Relative Humidity in three days.

The above highly preferred personal cleansing bar is more preferred when said hygroscopic synthetic surfactant is selected from the group consisting of alpha sulfo fatty acid esters; alkyl sulfates; alkyl ether carboxylates; alkyl betaines; alkyl sultaines; alkyl amine oxides; alkyl ether sulfates; and mixtures thereof.

This highly preferred personal cleansing bar is more preferred when said bar contains from about 0.5% to about 40% of salts and/or salt hydrates selected from the group consisting of: sodium chloride, sodium sulfate, disodium hydrogen phosphate, sodium pyrophosphate, sodium tetraborate, sodium acetate, sodium citrate, and other compatible salts of inorganic acids and short chain organic acids.

A highly preferred cleansing bar comprises: various combinations of the core structure of sodium soap fibers, water, mild synthetic surfactants, bar appearance stabilizers, skin mildness aides and other cleansing bar adjuvants. Such preferred bar can be formulated to have essentially no bar smear.

Some preferred bars of the present invention comprise: a rigid, interlocking mesh of neutralized carboxylic acid fiber-like core consisting essentially of sodium fatty acid soap composed of at least 50% saturated fatty alkyl chains having 12 to 24 carbon atoms. Preferably at least about 25% of said saturated alkyl chains are of a single chain length.

Some compositions of this invention comprise the above-defined rigid mesh with water and without water. These compositions must be formed with water or another suitable solvent system. The compositions can be made with large amounts of water and the water level in the final composition can be reduced to as low as about 1% or 2%.

However, it is a special advantage of some structures described herein that they can be dehydrated without loss of the integrity of the mesh. Some preferred shaped solids can be dehydrated without appreciable change in their outer dimensions. Other bars shrink while maintaining their three-dimensional form. Some bars herein have the unique characteristic that they are not destroyed by dehydration.

More complex bars of the present invention comprise a skeletal structure comprising other salts of fatty acids selected from potassium, magnesium, triethanolammonium and/or calcium soaps used in combination with the selected levels of sodium and/or lithium soaps. More complex cleansing bars can contain surprisingly large amounts of water, mild synthetic surfactants, bar appearance stabilizers, skin mildness aids and other cleansing bar adjuvants; yet are mild and have very good low smear.

Tables 1–3 set out some preferred bars which are made with the sodium salts of the fatty carboxylic acid (FA) soap.

The percentages, ratios, and parts herein are on a total composition weight basis, unless otherwise specified. All levels and ranges herein are approximations unless otherwise specified.

TABLE 1

| Preferred Bars, Chain Lengths and Levels | | | |
|---|---|---|---|
| | Preferred | More Preferred | Most Preferred |
| Water Level | 15–94% | 25–60% | 30–45% |
| Water:Soap Ratio | 0.7:1 | 1:1–5:1 | 1.5:1–2:1 |
| FA Chain Length | $C_{12-24}$ | $C_{14-22}$ | $C_{14-18}$ |
| FA Soap Level in Total Formulation | 6–50% | 15–35% | 15–30% |

All highs and lows are not necessarily shown in Table 1. For example, some selected sodium soap can be used at a level up to about 75%. Thus, the range is from about 5% to about 75%. The preferred levels and ratios can vary from cation to cation, etc., and from mono- to polycarboxylic acids.

The bars shown in Table 1 are made with the level of water indicated, but the water level of the final bars can be reduced to provide bars which contain reduced levels of water or even little or no water. A preferred level of water is from about 20% to about 80% by weight of the bar.

Table 2 below shows some preferred levels of soaps of a single FA chain length. Table 3 shows some preferred levels of unsaturation in the FA's used in the compositions of the present invention. Some preferred compositions contain little or no short chain FA's of ten carbon atoms or less. The terms "soap", "fatty acid (FA) salts" and "monocarboxylic acid salts" as used herein are sometimes interchangeable. "Soap" is used since it is easier to relate to and is the preferred embodiment.

TABLE 2

| The % Soap of Single Chain Length (of Total Fibrous Soap Content) | | | |
|---|---|---|---|
| | Preferred | More Preferred | Most Preferred |
| $C_{12-24}$ | 25–100% | 50–100% | 75–100% |

TABLE 3

| The Total % Unsaturated or Low ($C_{10}$ or less) Chain Length Soaps | | | |
|---|---|---|---|
| | Broad | Preferred | More Preferred |
| $C_{12}$ | 0–15% | 0–5% | 0–1% |
| $C_{14-24}$ | 0–50% | 0–10% | 0–1% |

The highs and lows of some key preferred optional ingredients for complex soap bar compositions of this invention are set out in Table 4. None of these ingredients is essential for the basic, preferred bar core structure. Zero is the lowest level for each optional ingredient. Some preferred bars can contain a total of from about 0.1% up to about 70% of such ingredients. The idea here is that the core bars can contain large amounts of other ingredients besides soap and water. The levels set out in Table 4 are particularly illustrative for bars containing from more than 5% to about 75% selected sodium soap and other ingredients.

It should be understood that solid shapes can be made with just lithium soap or just neutralized polycarboxylic acid, but would be expected to be somewhat different from the levels and ratios given for sodium soaps.

TABLE 4

Highs and Lows Wt. % of Other Ingredients for More Complex Sodium Soap Bars

| | Preferred | More Preferred | Most Preferred |
|---|---|---|---|
| Neutralized Dicarboxylic Acid | 1–40% | 2–30% | 5–25% |
| Lithium "Soap" | 1–40% | 2–30% | 5–25% |
| Potassium Soap | 1–10% | 2–10% | 5–8% |
| Magnesium or Calcium Soap | 1–35% | 1–12% | 3–8% |
| Triethanolammonium Soap | 1–15% | 2–15% | 5–10% |
| Synthetic Surfactant | 1–60% | 4–25% | 8–16% |
| Other Salts and Salt Hydrates | 0.5–50% | 1–25% | 2–15% |
| Non-Volatile, Water-Soluble Nonionic Organics | 1.0–50% | 2–40% | 5–20% |
| Polymeric Mildness Enhancers | 0.1–20% | 0.25–10% | 1–5% |
| Waxes | 0.1–40% | 2–35% | 3–10% |
| Other Impalpable | | | |
| Water-insolubles | 1–60% | 4–25% | 8–16% |
| Aluminosilicates/Clay | 0.5–25% | 1–10% | 3–8% |

The soaps useful in the present invention can be of the same alkyl chain lengths, i.e., which are selected from the 12 to 24 carbon atoms as set out in Table 2. The same chain lengths apply for the other non-sodium soaps used in the bars of the present invention.

The sodium soap is preferably at least about 50% of the soap present in the bar.

The levels of potassium soap and/or triethanolammonium soap should not exceed one-half, preferably one-third, more preferably less than one-fourth, that of the sodium soap and the level of magnesium soap should not exceed about one-third of the level of sodium soap, and is preferably less than about one-fourth that of the sodium soap.

The total of other soaps, save lithium soap, should preferably not exceed one-half, preferably one-third, of the sodium soap.

The synthetic detergent constituent of the bar compositions of the invention can be designated as being a detergent from the class consisting of anionic, nonionic, amphoteric and zwitterionic synthetic detergents. Both low and high lathering and high and low water-soluble surfactants can be used in the bar compositions of the present invention.

Examples of suitable synthetic detergents for use herein are those described in U.S. Pat. No. 3,351,558, Zimmerer, issued Nov. 7, 1967, at column 6, line 70 to column 7, line 74, incorporated herein by reference.

Examples include the water-soluble salts of organic, sulfonic acids and of aliphatic sulfuric acid esters, that is, water-soluble salts of organic sulfuric reaction products having in the molecular structure an alkyl radical of from 10 to 22 carbon atoms and a radical selected from the group consisting of sulfonic acid and sulfuric acid ester radicals.

Synthetic sulfate detergents of special interest are the normally solid alkali metal salts of sulfuric acid esters of normal primary aliphatic alcohol s having from 10 to 22 carbon atoms. Thus, the sodium and potassium salts of alkyl sulfuric acids obtained from the mixed higher alcohol s derived by the reduction of tallow or by the reduction of coconut oil, palm oil, stearine, palm kernel oil, babassu kernel oil or other oils of the coconut group can be used herein.

Other aliphatic sulfuric acid esters which can be suitably employed include the water-soluble salts of sulfuric acid esters of polyhydric alcohols incompletely esterified with high molecular weight soap-forming carboxylic acids. Such synthetic detergents include the water-soluble alkali metal salts of sulfuric acid esters of higher molecular weight fatty acid monoglycerides such as the sodium and potassium salts of the coconut oil fatty acid monoester of 1,2-hydroxypropane-3-sulfuric acid ester, sodium and potassium monomyristoyl ethylene glycol sulfate, and sodium and potassium monolauroyl diglycerol sulfate.

The synthetic surfactants and other optional materials useful in conventional cleaning products are also useful in the present invention. In fact, some ingredients such as certain hygroscopic synthetic surfactants which are normally used in liquids and which are very difficult to incorporate into normal cleansing bars are very compatible in the bars of the present invention. Thus, essentially all of the known synthetic surfactants which are useful in cleansing products are useful in the compositions of the present invention. The cleansing product patent literature is full of synthetic surfactant disclosures. Some preferred surfactants as well as other cleansing product ingredients are disclosed in the following references:

| U.S. Pat. No. | Issue Date | Inventor(s) |
|---|---|---|
| 4,061,602 | 12/1977 | Oberstar et al. |
| 4,234,464 | 11/1980 | Morshauser |
| 4,472,297 | 9/1984 | Bolich et al. |
| 4,491,539 | 1/1985 | Hoskins et al. |
| 4,540,507 | 9/1985 | Grollier |
| 4,565,647 | 1/1986 | Llenado |
| 4,673,525 | 6/1987 | Small et al. |
| 4,704,224 | 11/1987 | Saud |
| 4,788,006 | 11/1988 | Bolich, Jr., et al. |
| 4,812,253 | 3/1989 | Small et al. |
| 4,820,447 | 4/1989 | Medcalf et al. |
| 4,906,459 | 3/1990 | Cobb et al. |
| 4,923,635 | 5/1990 | Simion et al. |
| 4,954,282 | 9/1990 | Rys et al. |

All of said patents are incorporated herein by reference. Some preferred synthetic surfactants are shown the Examples herein. Preferred synthetic surfactant systems are selectively designed for bar appearance stability, lather, cleansing and mildness.

It is noted that surfactant mildness can be measured by a skin barrier destruction test which is used to assess the irritancy potential of surfactants. In this test the milder the surfactant, the lesser the skin barrier is destroyed. Skin barrier destruction is measured by the relative amount of radio-labeled water ($^3H$-$H_2O$) which passes from the test solution through the skin epidermis into the physiological buffer contained in the diffusate chamber. This test is described by T. J. Franz in the *J. Invest. Dermatol.*, 1975, 64, pp. 190–195; and in U.S. Pat. No. 4,673,525, Small et al., issued Jun. 16, 1987, incorporated herein by reference, and which disclose a mild alkyl glyceryl ether sulfonate (AGS) surfactant based synbar comprising a "standard" alkyl glyceryl ether sulfonate mixture. Barrier destruction testing is used to select mild surfactants. Some preferred mild synthetic surfactants are disclosed in the above Small et al. patents and Rys et al. Some specific examples of preferred surfactants are used in the Examples herein.

Some examples of good lather enhancing detergent surfactants, mild ones, are e.g., sodium lauroyl sarcosinate, alkyl glyceryl ether sulfonate, sulfonated fatty esters, paraffin sulfonates, and sulfonated fatty acids.

Numerous examples of other surfactants are disclosed in the patents incorporated herein by reference. They include other alkyl sulfates, anionic acyl sarcosinates, methyl acyl taurates, N-acyl glutamates, acyl isethionates, alkyl sulfosuccinates, alkyl phosphate esters, ethoxylated alkyl phosphate esters, trideceth sulfates, protein condensates, mixtures of ethoxylated alkyl sulfates and alkyl amine oxides, betaines, sultaines, and mixtures thereof. Included in the surfactants are the alkyl ether sulfates with 1 to 12 ethoxy groups, especially ammonium and sodium lauryl ether sulfates.

Alkyl chains for these other surfactants are $C_8$–$C_{22}$, preferably $C_{10}$–$C_{18}$. Alkyl glycosides and methyl glucose esters are preferred mild nonionics which may be mixed with other mild anionic or amphoteric surfactants in the compositions of this invention. Alkyl polyglycoside detergents are useful lather enhancers. The alkyl group can vary from about 8 to about 22 and the glycoside units per molecule can vary from about 1.1 to about 5 to provide an appropriate balance between the hydrophilic and hydrophobic portions of the molecule. Combinations of $C_8$–$C_{18}$, preferably $C_{12}$–$C_{16}$, alkyl polyglycosides with average degrees of glycosidation ranging from about 1.1 to about 2.7, preferably from about 1.2 to about 2.5, are preferred.

Sulfonated esters of fatty esters are preferred wherein the chain length of the carboxylic acid is $C_8$–$C_{22}$, preferably $C_{12}$–$C_{18}$; the chain length of the ester alcohol is $C_1$–$C_6$. These include sodium alpha sulfomethyl laurate, sodium alpha sulfomethyl cocoate, and sodium alpha sulfomethyl tallowate.

Amine oxide detergents are good lather enhancers. Some preferred amine oxides are $C_8$–$C_{18}$, preferably $C_{10}$–$C_{16}$, alkyl dimethyl amine oxides and $C_8$–$C_{18}$, preferably $C_{12}$–$C_{16}$, fatty acyl amidopropyl dimethyl amine oxides and mixtures thereof.

Fatty acid alkanol amides are good lather enhancers. Some preferred alkanol amides are $C_8$–$C_{18}$, preferably $C_{12}$–$C_{16}$, monoethanol amides, diethanolamides, and monoisopropanol amides and mixtures thereof.

Other detergent surfactants are alkyl ethoxy carboxylates having the general formula $$RO(CH_2CH_2O)_kCH_2COO^-M^+$$

wherein R is a $C_{8-22}$ alkyl group, k is an integer ranging from 0 to 10, and M is a cation; and polyhydroxy fatty acid amides having the general formula

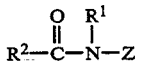

wherein $R^1$ is H, a $C_{1-4}$ alkyl group, 2-hydroxy ethyl, 2-hydroxy propyl, or mixtures thereof, $R^2$ is a $C_{5-31}$ hydrocarbyl, and Z is a polyhydroxyhydrocarbyl having a linear hydrocarbyl chain with at least 3 hydroxyl groups directly connected to the chain, or an alkoxylated derivative thereof.

Betaines are good lather enhances. Betaines such as $C_8$–$C_{18}$, preferably $C_{12}$–$C_{16}$, alkyl betaines, e.g., coco betaines or $C_8$–$C_{18}$, preferably $C_{12}$–$C_{16}$, acyl amido betaines, e.g., cocoamidopropyl betaine, and mixtures thereof, are preferred.

Some of the preferred surfactants are hygroscopic synthetic surfactants which absorb at least about 20% of their dry weight at 26° C. and 80% relative humidity in three days. Hygroscopic surfactants help to improve bar lather. Some preferred hygroscopic synthetic surfactants are listed below. Note that all are not hygroscopic.

HYGROSCOPICITY OF SOME SURFACTANTS

The hygroscopic surfactants are defined herein as having a minimum of 20% total moisture gain after 3 days at 26° C. and 80% Relative Humidity.

| | Total % Moisture Pick-Up* |
|---|---|
| Class: Nonionic | |
| Sulfonates | |
| Sodium $C_8$ Glyceryl Ether Sulfonate | 39.8 |
| Sodium $C_{12-14}$ Glyceryl Ether Sulfonate | 22.9 |
| Sodium $C_{16}$ Glyceryl Ether Sulfonate | 71.4 |
| Sodium Cocomonoglyceride Sulfonate | 3.5 |
| Sodium Salt of $C_{8-16}$ Alkyl Glyceryl Ether Sulfonates | |
| Alpha Sulfo Esters and Acids | |
| Sodium Alpha Sulfo Methyl Laurate/Myristate | 39.3 |
| Sodium Alpha Sulfo Methyl Myristate | 44.5 |
| Sodium Alpha Sulfo Hexyl Laurate | 23.2 |
| Sodium Alpha Sulfo Methyl/Hexyl Laurate and Myristate | 26.3 |
| Sodium Alpha Sulfo Methyl Palmitate | 3.7 |
| Sodium Alpha Sulfo Methyl Stearate | 4.2 |
| Sodium 2-Sulfo Lauric Acid | 0.2 |
| Sodium 2-Sulfo Palmitic Acid | 3.8 |
| Sodium 2-Sulfo Stearic Acid | 0.0 |
| $Na^+R1-C(SO_{3-})-CO_2R_2$ | |
| $R_1 = C_{8-14}$ alkyl; $R_2 = C_{1-8}$ alkyl | |
| Sodium Alkyl Isethionates | |
| Sodium Lauryl Isethionate | 31.7 |
| Sodium Cocoyl Isethionate | 11.0 |
| Sarcosinates | |
| Sodium Lauryl Sarcosinate | 8.8 |
| Sodium Stearyl Sarcosinate | 13.3 |
| Sodium Cocoyl Sarcosinate | 18.7 |
| Alkyl Sulfates | |

-continued

| | Total % Moisture Pick-Up* |
|---|---|
| Sodium Lauryl Sulfate | 28.2 |
| Sodium Laureth-1 Sulfate | 37.6 |
| Sodium Oleyl Sulfate | 20.3 |
| Sodium Cetearyl Sulfate | 4.7 |
| Sodium Cetyl Sulfate | 2.25 |
| Na + $R1(OCH_2CH_2)_nOSO_3-$ | |
| $R_1$ = $C_{8-14}$ alkyl, $C_{16-20}$ alkyl(ene) with at least one double bond, n = 0–18 | |
| Acyl Glutamates | |
| Sodium Cocoyl Glutamate | 26.7 |
| Sodium Lauryl Glutamate | 17.8 |
| Sodium Myristyl Glutamate | 18.1 |
| Sodium Stearyl Glutamate | 12.0 |
| Alkyl Ether Carboxylates | |
| Sodium Laureth-5 Carboxylate | 32.2 |
| Sodium Palmityl-20 Carboxylate | 50.2 |
| Na + $R1-(O—CH_2CH_2)_nCO_2-$ | |
| $R_1$ = $C_{8-18}$ alkyl, n = 1–30 | |
| Sulfosuccinates | |
| Disodium Laureth Sulfosuccinate | 33.6 |
| Phosphates | |
| Sodium Monoalkyl (70% $C_{12}$/30% $C_{14}$) Phosphate | 21.1 |
| Class: Amphoterics | |
| Betaines | |
| Coco Betaine | 70.0 |
| Cocoamidopropyl Betaine | 48.2 |
| Palmitylamidopropyl Betaine | 46.5 |
| Isostearamidopropyl Betaine | 44.3 |
| Sultaines | |
| Cocoamidopropylhydroxy Sultaine | 59.5 |
| Amine Oxides | |
| Palmityl Dimethyl Amine Oxide | 34.0 |
| Myristyl Dimethyl Amine Oxide | 46.0 |
| Cocoamidopropyl Amine Oxide | 43.3 |
| Protein Derived | |
| Na/TEA $C_{12}$ Hydrolyzed Keratin | 34.7 |

*3 days, 26° C./80% Relative Humidity

Polymeric skin mildness aids are disclosed in the Small et al. and Medcalf et al. patents. Both cationic polysaccharides and cationic synthetic polymers are disclosed. The cationic synthetic polymers useful in the present invention are cationic polyalkylene imines, ethoxypolyalklene imines, and poly[N-[-3-(dimethylammonio)propyl]-N'-[3-(ethyleneoxyethylene dimethylammonio)propyl]urea dichloride] the latter of which is available from Miranol Chemical Company, Inc. under the trademark of Miranol A-15, CAS Reg. No. 68555-36-2.

Preferred cationic polymeric skin conditioning agents of the present invention are those cationic polysaccharides of the cationic guar gum class with molecular weights of 1,000 to 3,000,000. More preferred molecular weights are from 2,500 to 350,000. These polymers have a polysaccharide backbone comprised of galactomannan units and a degree of cationic substitution ranging from about 0.04 per anhydroglucose unit to about 0.80 per anhydroglucose unit with the substituent cationic group being the adduct of 2,3-epoxypropyltrimethyl ammonium chloride to the natural polysaccharide backbone. Examples are JAGUAR C-14-S, C-15 and C-17 sold by Celanese Corporation. In order to achieve the benefits described in this invention, the polymer must have characteristics, either structural or physical which allow it to be suitably and fully hydrated and subsequently well incorporated into the soap matrix.

A mild skin cleansing bar of the present invention can contain from about 0.5% to about 20% of a mixture of a silicone gum and a silicone fluid wherein the gum:fluid ratio is from about 10:1 to about 1:10, preferably from about 4:1 to about 1:4, most preferably from about 3:2 to about 2:3.

Silicone gum and fluid blends have been disclosed for use in shampoos and/or conditioners in U.S. Pat. Nos. 4,906,459, Cobb et al., issued Mar. 6, 1990; 4,788,006, Bolich, Jr. et al., issued Nov. 29, 1988; 4,741,855, Grote et al., issued May 3, 1988; 4,728,457, Fielet et al., issued Mar. 1, 1988; 4,704,272, Oh et al., issued Nov. 3, 1987; and 2,826,551, Geen, issued Mar. 11, 1958, all of said patents being incorporated herein by reference.

The silicone component can be present in the bar at a level which is effective to deliver a skin mildness benefit, for example, from about 0.5% to about 20%, preferably from about 1.5% to about 16%, and most preferably from about 3% to about 12% of the composition. Silicone fluid, as used herein, denotes a silicone with viscosities ranging from about 5 to about 600,000 centistokes, most preferably from about 350 to about 100,000 centistokes, at 25° C. Silicone gum, as used herein, denotes a silicone with a mass molecular weight of from about 200,000 to about 1,000,000 and with a viscosity of greater than about 600,000 centistokes. The molecular weight and viscosity of the particular selected siloxanes will determine whether it is a gum or a fluid. The silicone gum and fluid are mixed together and incorporated into the compositions of the present invention.

Other ingredients of the present invention are selected for the various applications. E.g., perfumes can be used in formulating the skin cleansing products, generally at a level of from about 0.1% to about 2.0% of the composition. Alcohols, hydrotropes, colorants, and fillers such as talc, clay, water-insoluble, impalpable calcium carbonate and dextrin can also be used. Cetearyl alcohol i s a mixture of cetyl and stearyl alcohol s. Preservatives, e.g., sodium ethylenediaminetetraacetate (EDTA), generally at a level of less than 1% of the composition, can be incorporated in the cleansing products to prevent color and odor degradation. Antibacterials can also be incorporated, usually at levels up to 1.5%. The above patents disclose or refer to such ingredients and formulations which can be used in the bars of this invention, and are incorporated herein by reference.

Some bars of this invention contain from about more than 5% to about 75% said sodium fatty acid soap fibers; from about 10% to about less than 94% water; and at least about 1% of another bar ingredient selected from: other soaps, moisturizers, colorants, solvents, fillers, synthetic detergent surfactants, polymeric skin feel and mildness aids, perfumes, preservatives, and mixtures thereof.

Some bars of this invention comprise: more than 5% to 50% fibrous sodium fatty acid soap composed of at least about 50% saturated fatty alkyl chains having 12–24 carbon atoms of which at least about 25% of said saturated fatty alkyl chains is of a single chain length.

Some bars of this invention comprise said fibers which occupy from about 3% to about 75%, preferably from about 15% to about 40%, of the volume of the bar structure.

Some bars comprise a rigid, low smearing structure of: more than 5% to 75% sodium fatty acid soap composed of at least about 50% saturated fatty alkyl chains having 12–24 carbon atoms of which at least about 25% of said saturated fatty alkyl chains is of a single chain length; from about 10% to about 94% water; and about 0% to a total of about 70% of other selected soap bar ingredients selected from the group set out above in Table 4.

Some personal cleansing soap bar compositions comprise a rigid interlocked mesh of sodium soap fibers; wherein the sodium fatty acid soap is composed of at least about 50% saturated fatty alkyl chains having 12–24 carbon atoms of which at least about 25% of said saturated fatty alkyl chains is of a single chain length; and from about 2% to about 40% by weight of a hygroscopic synthetic surfactant wherein said hygroscopic synthetic surfactant is selected from surfactants which absorb at least about 20% of its dry weight in water at 26° C. and 80% Relative Humidity in three days.

BAR APPEARANCE AIDS

Bar appearance (water-retaining and/or shrinkage prevention) aids are preferably selected from the group consisting of:

compatible salt and salt hydrates;

water-soluble organics such as polyols, urea;

aluminumosilicates and clays; and mixtures thereof, as set out above in Table 4.

Water-soluble organics are also used to stabilize the appearance of the bar soaps of the present invention. Some preferred water-soluble organics are propylene glycol, glycerine, ethylene glycol, sucrose, and urea, and other compatible polyols.

A particularly suitable water-soluble organic is propylene glycol. Other compatible organics include polyols, such as ethylene glycol or 1,7-heptane-diol, respectively the mono- and polyethylene and propylene glycols of up to about 8,000 molecular weight, any mono-$C_{1-4}$ alkyl ethers thereof, sorbitol, glycerol, glycose, diglycerol, sucrose, lactose, dextrose, 2-pentanol, 1-butanol, mono- di- and triethanolammonium, 2-amino-1-butanol, and the like, especially the polyhydric alcohols.

The term "polyol" as used herein includes non-reducing sugar, e.g., sucrose. Sucrose will not reduce Fehling's solution and therefore is classified as a "non-reducing" disaccharide. Unless otherwise specified, the term "sucrose" as used herein includes sucrose, its derivatives, and similar non-reducing sugars and similar polyols which are substantially stable at a soap processing temperature of up to about 210° F. (98° C.), e.g., trialose, raffinose, and stachyose; and sorbitol, lactitol and maltitol.

Compatible salt and salt hydrates are used to stabilize the bar soap appearance via the retention of water. Some preferred salts are sodium chloride, sodium sulfate, disodium hydrogen phosphate, sodium pyrophosphate, sodium tetraborate.

Generally, compatible salts and salt hydrates include the sodium, potassium, magnesium, calcium, aluminum, lithium, and ammonium salts of inorganic acids and small (6 carbons or less) carboxylic or other organic acids, corresponding hydrates, and mixtures thereof, are applicable. The inorganic salts include chloride, bromide, sulfate, metasilicate, orthophosphate, pyrophosphate, polyphosphate, metaborate, tetraborate, and carbonate. The organic salts include acetate, formate, methyl sulfate, and citrate.

Water-soluble amine salts can also be used. Monoethanolamine, diethanolamine, and triethanolammonium (TEA) chloride salts are preferred.

Aluminosilicates and other clays are useful in the present invention. Some preferred clays are disclosed in U.S. Pat. Nos. 4,605,509 and 4,274,975, incorporated herein by reference.

Other types of clays include zeolite, kaolinite, montmorillonite, attapulgite, illite, bentonite, and halloysite. Another preferred clay is kaolin.

Waxes include petroleum based waxes (paraffin, microcrystalline, and petrolatum), vegetable based waxes (carnauba, palm wax, candelilla, sugarcane wax, and vegetable derived triglycerides) animal waxes (beeswax, spemaceti, wool wax, shellac wax, and animal derived triglycerides), mineral waxes (montar, ozokerite, and ceresin) and synthetic waxes (Fischer-Tropsch).

A preferred wax is used in the Examples herein. A useful wax has a melting point (M.P.) of from about 120° F. to about 185° F. (49°–85° C.), preferably from about 125° F. to about 175° F. (52°–79° C.). A preferred paraffin wax is a fully refined petroleum wax having a melting point ranging from about 130° F. to about 140° F. (49°–60° C.). This wax is odorless and tasteless and meets FDA requirements for use as coatings for food and food packages. Such paraffins are readily available commercially. A very suitable paraffin can be obtained, for example, from The Standard Oil Company of Ohio under the trade name Factowax R-133.

Other suitable waxes are sold by the National Wax Co. under the trade names of 9182 and 6971, respectively, having melting points of 131° F. and 130° F. (~55° C.).

The paraffin preferably is present in the bar in an amount ranging from about 5% to about 20% by weight. The paraffin ingredient is used in the product to impart skin mildness, plasticity, firmness, and processability. It also provides a glossy look and smooth feel to the bar.

The paraffin ingredient is optionally supplemented by a microcrystalline wax. A suitable microcrystalline wax has a melting point ranging, for example, from about 140° F. (60° C.) to about 185° F. (85° C.), preferably from about 145° F. (62° C.) to about 175° F. (79° C.). The wax preferably should meet the FDA requirements for food grade microcrystalline waxes. A very suitable microcrystalline wax is obtained from Witco Chemical Company under the trade name Multiwax X-145A. The microcrystalline wax preferably is present in the bar in an amount ranging from about 0.5% to about 5% by weight. The microcrystalline wax ingredient imparts pliability to the bar at room temperatures.

EXAMPLES

The following examples are illustrative and are not intended to limit the scope of the invention. Unneutralized or "free" fatty acids, as used in the examples, are of the same chain lengths as those used to make the soaps, unless otherwise specified. All levels and ranges, temperatures, results, etc., used herein, are approximations unless otherwise specified.

A FRAME PROCESS FOR MAKING THE BARS OF THE PRESENT INVENTION

The cleansing bars in the Examples are made by the following procedure unless otherwise specified:

1. Fatty acid precursor, propylene glycol, sodium chloride, and water (excluding water coming in with other raw materials) are mixed and heated to 71° C.
2. Caustic solution (50% sodium hydroxide) is added and the mixture is stirred until smooth forming an aqueous molten liquid comprising from 15% to 94% water and from 5.5% to 75% soap (neutralized carboxylic acid). The temperature during neutralization of the molten liquid increases to ~95° C.
3. Other ingredients are added preferably in the following order and the temperature is maintained at ~88° C.: coco betaine; sodium lauroyl sarcosinate; or sodium alphsulfo methyl cocoate; kaolin clay; or hydrated zeolite (synthetic sodium aluminosilicate); and paraffin. Perfume is added last.
4. The molten liquid mixture is poured into shaped molds.
5. The molten liquid crystallizes (solidifies) on cooling to room temperature and the resultant bars are removed from the molds.

The bars of the examples are made using the above general procedure, unless otherwise specified.

It is important to note that, when the formulations which are used in the Examples of the present invention are subjected to a conventional plodding or freezer process very soft or no bars are formed. Example II is a very highly preferred overall bar.

TABLE 5

| Ingredient | Preferred Bars Ex. I (Wt. %) | Ex. II (Wt. %) | Ex. III (Wt. %) | Ex. IV (Wt. %) |
|---|---|---|---|---|
| Na $C_{14}$ Soap | 20 | 20 | — | — |
| Na $C_{16}$ Soap | — | — | 20 | 16 |
| K $C_{16}$ Soap | — | — | — | 4 |
| Free Fatty Acid | 1 | 1 | 1 | 1 |
| Sodium Lauroyl Sarcosinate | 7 | 7 | 12 | — |
| Sodium Alpha Sulfo | — | — | — | 7 |

TABLE 5-continued

| Ingredient | Preferred Bars Ex. I (Wt. %) | Ex. II (Wt. %) | Ex. III (Wt. %) | Ex. IV (Wt. %) |
|---|---|---|---|---|
| Methyl Cocoate | | | | |
| Coco Betaine | 5 | 5 | 7 | 5 |
| Sodium Chloride | 3.0 | 3.0 | 3.0 | 3.0 |
| Propylene Glycol | 14.5 | 14.5 | 14.5 | 15.0 |
| Hydrated Zeolite A (Aluminosilicate) | 4.0 | | 4.0 | — |
| Kaolin Clay | | 4.0 | — | 4.0 |
| Paraffin (M.P. = 55° C.) | 6.5 | 6.5 | 4.5 | — |
| Perfume | 1 | 1 | 1 | 1 |
| Water | 37.25 | 37.25 | 31.95 | 36.25 |
| Hardness (mm) | 5.5 | 6.4 | 4.2 | 5.1 |
| Smear | 9.5 | 9.0 | 8.5 | 8.5 |

DESCRIPTION OF TESTING FOR EXAMPLES

Bar Hardness Test

1. The hardness of a bar is determined by measuring at 25° C. the depth of penetration (in mm) into the bar of a 247 gram Standard Weighted Penetrometer Probe having a conically shaped needle attached to a 22.9 cm (9 inch) shaft weighing 47 grams with 200 grams on top of said shaft. A hardness measurement of 5 mm or less indicates a very hard bar; 5–10 mm indicates a moderately hard bar; 10–12 mm indicates a somewhat soft bar of marginal acceptance; and greater than 12 mm indicates a very soft bar that is unacceptable for most uses. This defines "hardness" as used herein unless otherwise specified.

Bar Smear Test

2. The smear grade is determined by a (1) placing a soap bar on a perch in a 1400 mm diameter circular dish; (2) adding 200 ml of room temperature water to the dish such that the bottom 3 mm of the bar is submerged in water; (3) letting the bar soak overnight (15 hours); (4) turn the bar over and grade qualitatively for the combined amount of smear, and characteristics of smear, depth of smear on a scale where 10 equals no smear, 8.0–9.5 equals low smear amount, 5.0–7.5 equals moderate smears similar to most marketed bars, and 4.5 or less equals very poor smear.

Commercial soap bars, e.g., SAFEGUARD®, ZEST®, IVORY®, and LAVA®, have smears of about 5, 6, 6, and 6, respectively. See Table 12 for more data.

Bar Shrinkage Test

3. Shrinkage is measured by placing a freshly made unwrapped bar in a room that is held at 26° C. and 15% relative humidity for one week. The amount of shrinkage from the original bar shape is determined on a qualitative scale where 0 indicates no shrinkage, + indicates slight shrinkage, ++ indicates moderate shrinkage, and +++ indicates great shrinkage.

In Tables 6 and 7, soap bars 1–10 are set out to show bar hardness, smear and shrinkage for $C_{10}$, $C_{12}$, $C_{14}$, $C_{16}$, and $C_{18}$ alkyl chain soaps as shown. The preferred alkyl chain soaps of the present invention are set out above in Tables 1 and 2.

The term "X." means that the example is a comparative example.

TABLE 6

| Single Saturated Chain Length Sodium Soap/Water Study | | | | | |
|---|---|---|---|---|---|
| Ingredient | Ex. 1 Wt. % | Ex. 2 Wt. % | Ex. 3 Wt. % | Ex. 4 Wt. % | Ex. 5 Wt. % |
| Sodium Soap | | | | | |
| $C_{10}$ | 33 | — | — | — | — |
| $C_{12}$ | — | 33 | — | — | — |
| $C_{14}$ | — | — | 33 | — | — |
| $C_{16}$ | — | — | — | 33 | — |
| $C_{18}$ | — | — | — | — | 33 |
| Free Fatty Acid | 1.0 | 1.0 | 1.0 | 1.0 | 2.0 |
| Excess Sodium Hydroxide | | | | | |
| Sodium Chloride | 2.0 | 1.0 | 1.0 | 1.0 | 1.0 |
| Water | 64 | 65 | 65 | 65 | 64 |
| Hardness (mm) | 8.9 | 2.3 | 2.2 | 5.4 | 4.2 |
| Smear | 3 | 10 | 10 | 9.5 | 10.0 |
| Shrinkage | | +++ | +++ | + | 0 |

Note that Ex. 1 has a very poor smear, notwithstanding a hardness of 8.9 as the smear methodology dissolves away the soluble $C_{10}$ soap.

TABLE 7

| Single Chain Length Sodium Soap/Water Study | | | | | |
|---|---|---|---|---|---|
| Ingredient | X. 6 Wt. % | Ex. 7 Wt. % | Ex. 8 Wt. % | Ex. 9 Wt. % | Ex. 10 Wt. % |
| Sodium Soap | | | | | |
| $C_{12}$ | — | — | — | 15 | 5 |
| $C_{16}$ | — | 10 | — | — | — |
| $C_{18}$ | — | — | 10 | — | — |
| $C_{18}$:1 | 33 | — | — | — | — |
| Free Fatty Acid | 1.0 | — | 2.0 | 1.0 | — |
| Excess Sodium Hydroxide | — | 0.07 | — | — | — |
| Sodium Chloride | 1.0 | 1.0 | 1.0 | 1.0 | 1.0 |
| Water | 65 | 87 | 82.8 | 83 | 94 |
| Hardness (mm) | ** | 11.8 | 11.9 | | 14.0 |
| Smear | | 10.0 | 10.0 | | 9.0 |
| Shrinkage | | 0 | +++ | ++++ | ++++ |

**Solid bar not formed due to too much unsaturated soap.

Example 10 has the rigid structure, but is not preferred as a cleaning bar because its hardness is 14.

TABLE 8

| Binary Chain Length Sodium Soap/Water Study | | | |
|---|---|---|---|
| Ingredient | X. 11 Wt. % | Ex. 12 Wt. % | Ex. 13 Wt. % |
| Sodium Soap | | | |
| $C_{10}$ | — | — | 16.5 |
| $C_{12}$ | 16.5 | — | — |
| $C_{14}$ | — | 16.5 | 16.5 |
| $C_{18}$:1 | 16.5 | 16.5 | — |
| Free Fatty Acid | 1.0 | 1.0 | 1.0 |
| Excess Sodium Hydroxide | | | |
| Sodium Chloride | 1.0 | 1.0 | 1.0 |
| Water | 65 | 65 | 65 |
| Hardness (mm) | ** | 9.0 | 9.0 |
| Smear | | 9.0 | 8.0 |

**Solid Bar not formed due to too much unsaturation combined with $C_{12}$ soap.

TABLE 9

| Binary Saturated Chain Length Sodium Soap/Water Study | | | |
|---|---|---|---|
| Ingredient | Ex. 14 Wt. % | Ex. 15 Wt. % | Ex. 16 Wt. % |
| Sodium Soap | | | |
| $C_{12}$ | 16.5 | — | — |
| $C_{14}$ | 16.5 | — | — |
| $C_{16}$ | — | 16.5 | 10 |
| $C_{18}$ | — | 16.5 | 10 |
| Free Fatty Acid | 1.0 | 1.0 | 1.0 |
| Sodium Chloride | 1.0 | 1.0 | 1.0 |

TABLE 9-continued

| Binary Saturated Chain Length Sodium Soap/Water Study | | | |
|---|---|---|---|
| Ingredient | Ex. 14 Wt. % | Ex. 15 Wt. % | Ex. 16 Wt. % |
| Water | 65 | 65 | 78 |
| Hardness (mm) | 2.8 | 4.5 | 7.3 |
| Smear | 9.5 | 10.0 | 10.0 |
| Shrinkage | | 0 | ++ |

Examples 12–16 are excellent bars of the present invention.

TABLE 10

| Complex Chain Length Sodium Soap/Water Study | | | |
|---|---|---|---|
| Ingredient | Ex. 17 Wt. % | Ex. 18 Wt. % | Ex. 19 Wt. % |
| Sodium Soap* | | | |
| Emersol 132 | — | (33) | (15) |
| $C_8$ | 0.56 | — | — |
| $C_{10}$ | 0.64 | — | — |
| $C_{12}$ | 10.14 | 0.12 | 8.1 (8.0) |
| $C_{14}$ | 4.54 | 0.79 | 10.4 (10.0) |
| $C_{16}$ | 8.51 | 15.6 | 7.10 |
| $C_{17}$ | 0.76 | 0.76 | 0.35 |
| $C_{18}$ | 19.85 | 15.3 | 7.0 |
| $C_{20}$ | — | 0.26 | 0.12 |
| Free Fatty Acid | — | 1.0 | — |
| Sodium Chloride | 1.1 | 1.0 | 1.0 |
| Water | 53.9 | 65 | 66 |
| Hardness (mm) | 7.6 | 4.7 | 5.8 |
| Smear | 9.5 | 10 | 9.5 |
| Shrinkage | | + | ++ |

*Composition by Chain Length, () indicate actual level of materials.

Examples 17–19 are made with more complex mixtures of soaps than the prior examples. They form very good bars of the present invention. They have little or no smear. Compare their hardness and smears with those made with conventional tallow and coconut soap shown in Table 11.

TABLE 11

| Complex Chain Length Sodium Soap/Water Study | | | |
|---|---|---|---|
| Ingredient | X. 20 Wt. % | X. 21 Wt. % | X. 22 Wt. % |
| Sodium Soap* | | | |
| Tallow | (33) | — | (26.4) |
| Coconut | — | (33) | (6.6) |
| $C_8$ | — | 2.31 | 0.46 |
| $C_{10}$ | — | 2.0 | 0.40 |
| $C_{12}$ | — | 16.5 | 3.3 |
| $C_{14}$ | 1.0 | 5.94 | 4.95 |
| $C_{16}$ | 7.92 | 2.81 | 6.90 |
| $C_{18}$ | 0.5 | — | 0.40 |
| $C_{20}$ | 6.6 | 1.0 | 5.48 |
| $C_{14}$:1 | 0.33 | — | 0.26 |
| $C_{16}$:1 | 0.83 | — | 0.66 |
| $C_{18}$:1 | 14.2 | 2.0 | 11.76 |
| $C_{18}$:2 | 0.75 | 0.5 | 0.7 |
| Free Fatty Acid | 1.0 | 1.0 | 1.0 |
| Sodium Chloride | 1.0 | 1.0 | 1.0 |
| Water | 65 | 65 | 65 |
| Hardness (mm) | Soft | 15.8 | 12.5 |
| Smear | Poor | 3.0 | 5.0 |

*Composition by Chain Length, () indicate actual level of materials.

These comparative examples, X.20, X.21, and X.22, do not form the rigid structure of the present invention. Note that they are made with the typical commercial soaps. They are soft soaps with terrible smears. Compare with Example 15 of the present invention which is made with 65% water and $C_{16}$ and $C_{18}$ saturated soap and forms a hard bar with no smear.

Example 23 i a bar of the present invention which contains more synthetic surfactant than soap. It has low smear and good lather. Example 24 is a bar of the present invention which contains polymer and other bar soap ingredients.

| Syndet Bar Example | |
|---|---|
| Ingredient | Wt. % |
| Sodium Palmitate | 20 |
| Sodium Lauroyl Sarcosinate | 9* |
| Sodium Laureth-3 Sulfate | 7* |
| Sodium Cetearyl Sulfate | 5* |
| Free Fatty Acid (Palmitic) | 1 |
| Sodium Chloride | 3 |
| Propylene Glycol | 14 |
| Hydrated Zeolite A | 3 |
| Perfume | 1 |
| Water | 37 |

*Total 21% Synthetic Surfactant

EXAMPLE 24

| Polymer-Containing Example | |
|---|---|
| Ingredient | Wt. % |
| Sodium Palmitate | 20 |
| Sodium Alpha-Sulfo Methyl Cocoate | 8.7 |
| Coco Betaine | 4.65 |
| Jaguar C376 | 1.5 |
| Propylene Glycol | 15 |
| Kaolin Clay | 5 |
| Paraffin, (M.P. = 55° C.) | 4.5 |
| Sodium Chloride | 3 |
| Perfume | 1 |
| Water | 35.5 |

Examples 23 and 24 are similar to Example IV of Table 5.

Example 24 is a mild bar formulation with polymeric skin mildness aid.

EXAMPLES 25-27

| Ingredient | Ex. 25 Wt. % | Ex. 26 Wt. % | Ex. 27 Wt. % |
|---|---|---|---|
| Lithium Myristate | 33 | — | — |
| Lithium Chloride | 5 | — | — |
| Disodium Salt of Dodecanedioic Acid | — | 20 | 20 |
| Sodium Lauroyl Sarcosinate | — | — | 5 |
| Water | 62 | 80 | 75 |
| Penetration Values | N/A | N/A | N/A |

N/A = Not available

For Example 25, the formulation is prepared by heating the fatty acid precursor to 71° C., separately adding lithium hydroxide to water, and then adding the fatty acid and lithium hydroxide solution together, mixing together for 30 minutes maintaining the heat at least at 71° C., adding lithium chloride salt and stirring for an additional 5 minutes, then pouring into a mold and letting cool and solidify. A solid bar with excellent smear properties is formed.

For Examples 26 and 27, the diacid is melted (150°-180° C.) and a hot (90° C.) caustic solution (two equivalents of NaOH) is added. The mixture is stirred for ~5 minutes. For Example 27, the sodium lauroyl sarcosinate is predissolved in the caustic/water solution. The bar becomes solid on cooling, with further hardening occurring upon degradation, e.g., to about 35-40% water by weight of the bar.

Example 25 demonstrates the ability to form high moisture, firm and non-smearing bars without the need for sodium soap. Examples 26 and 27 demonstrate the ability to form a totally soap-free product and still obtain the relatively rigid intermeshed fiber structure.

FREEZER BAR EXAMPLE 28

Example 28 below is made by a freezer bar process disclosed in commonly assigned, U.S. pat. application Ser. No. 07/731,163, Taneri et al., filed Jul. 15, 1991, abandoned. This process provides a personal cleansing freezer bar comprising a skeleton structure having a relatively rigid, interlocking, semi-continuous, open, three-dimensional, crystalline mesh of neutralized carboxylic acid soap made by the following steps:

(1) mixing a molten mixture comprising by weight of said bar: from about 15% to about 85% of said soap and from about 15% to about 40% water;
(2) cooling said mixture to a semi-solid in a scraped wall heat exchanger freezer;
(3) extruding said semi-solid as a soft plug; and
(4) further cooling and crystallizing said soft plug until firm to provide said personal cleansing freezer bar.

Step 1—Mixing

The soap specified in the formulation is made in situ by mixing the desired fatty acids, consisting essentially of $C_{12}$-$C_{24}$ chain lengths, with the appropriate base or mixture of bases, consisting essentially of sodium, lithium, magnesium, calcium, and potassium hydroxide and triethanolamine. The fatty acid, base, and water are mixed at from about 170° F. to about 200° F. (76°-93° C.) to form the soap. In Example 28, 180° F. is used. Sufficient water is used such that the mixture is stirrable. The other ingredients are added, maintaining the temperature of from about 180° F. to about 200° F. (82°-93° C.). Example 28—180° F. The optimal mixing temperatures can vary depending on the particular formulation.

Step 2 Optionals—Aeration, Minor Addition, and Flash Drying Optionals

Aerate (optional) said mix and add perfume (only if drying) and other minors with positive displacement pump or other in-line mixer. Example 28 is not aerated or dried. The mixture of Step (1) is optionally dried to reduce the amount of said water to the desired level, preferably 20-40% water. The flash drying temperature is from about 225° F. to about 315° F. (135°-157° C.) at pressure of from about 30 to abut 100 psi (115-517 mm Hg).

Step 3—Freezer

Cool the mix using a scraped wall heat exchanger (freezer) to partially crystallize the components from an initial temperature of from about 180° F. to about 200° F. (82°-93° C.) or from about 200° F. to about 220° F. (93°-104° C.), if dried, to a final temperature preferably from about 135° F. to about 180° F. (57°-82° C.), more preferably from about 145° F. to about 180° F. (63°-82° C.), and most preferably from about 155° F. to about 175° F. (68°-79° C.). This final temperature, also referred to herein as the Freezer Outlet Temperature (FOT), is typically the maximum temperature that will form a smooth plug that holds its shape once extruded onto a moving belt (Step 4). The FOT for Example 28 is 175° F.

Step 4—Extrusion

The cooled mix of Step 3 is extruded out onto a moving belt as a soft plug which is then cooled and fully crystallized and then stamped and packaged. The plugs are preferably formed via an extrusion operation, as shown in U.S. Pat. No. 3,835,059, supra. Some of the composition crystallizes in the freezer (Step 3) in order to provide a semi-solid having a sufficient viscosity to stand up on the belt, while further crystallization occurs after extrusion, resulting in hardening of the bar. The final crystallization of the sodium soap forms the interlocking, semi-continuous, open mesh structure in the freezer bar of the present invention.

EXAMPLE 28

| Ingredient | Wt. % |
|---|---|
| Sodium $C_{14}$ Soap | 27.99 |
| Magnesium $C_{14}$ Soap | 5.00 |
| Sodium Lauroyl Sarcosinate | 3.00 |
| Coco Betaine | 10.00 |
| Propylene Glycol | 3.50 |
| Petrolatum | 22.49 |
| Sodium Chloride | 2.58 |
| Free Fatty Acid, $C_{14}$ | 0.50 |
| Perfume | 0.50 |
| Water | 24.44 |

The Plodding Stamped Bar Hardness Test

The Plodding Stamped Bar Hardness Test can be used to differentiate the bars of this invention from other bars. Four trade bars are selected that represent various soap processes: SAFEGUARD®, a soap milled bar; ZEST®, a soap/synthetic milled bar; IVORY®, a freezer bar; and LAVA®, a framed bar. Samples of these market bars and formed bars of Example 28 and Example II are plodded using the procedure set out below.

Overall, the market bars after plodding are much harder and have a better smear versus Example 28 or Example II after plodding. This data is detailed in Table 12. This test clearly is an excellent method of differentiating bars containing the rigid skeletal structure versus other bars. Simply stated, the bars of this invention will become much more soft after replodding than conventional bars.

The procedure is as follows:

1. Formed bars (about 2.5 Kg or greater) are placed into a single stage plodder (4 inch/10.16 cm bonnet single stage plodder) without vacuum and are run through a noodle plate. The noodle plate contains nineteen 0.37 inch (0.93 cm) holes in a 3.1 inch (8 cm) plate. The barrel temperature is set at 120° F. (49° C.) and the nose temperature is set at 110° F. (43.5° C.).
2. Step 1 is repeated with the noodles.
3. The noodles of Step 2 are placed into the single stage plodder (4 inch/10.16 cm bonnet single stage plodder) with vacuum applied and run through a brick-shaped orifice. A brick-shaped plug with approximate dimensions of 1.88 inches (4.6 cm) (height) by 1.16 inches (3 cm) (width) by 3 inches (7.6 cm) (length) is extruded. These plugs should have an interior temperature of 90° F. (32° C.) to 105° F. (41° C.).
4. These plugs are stamped into a brick shape and are allowed to cool to room temperature (at least 12 hours) before evaluation.

TABLE 12

Bar Plodder Data

| | Bar | Hardness (mm)* |
|---|---|---|
| 1 | SAFEGUARD® Market Bar | 3.18 |
| 2 | SAFEGUARD® (Plodded/Stamped) | 3.13 |
| | Delta (The value of Bar 1-Bar 2) | 0.05 |
| 1 | ZEST® Market Bar | 2.25 |
| 2 | ZEST® (Plodded/Stamped) | 2.33 |
| | Delta | (0.08) |
| 1 | IVORY® Market Bar | 1.93 |
| 2 | IVORY® (Plodded/Stamped) | 3.03 |
| | Delta | (1.10) |
| 1 | LAVA® Market Bar | 1.90 |
| 2 | LAVA® (Plodded/Stamped) | 2.47 |
| | Delta | (0.57) |
| 1 | Example 28 (Formed Bar) | 3.35 |
| 2 | Example 28 (Plodded/Stamped) | 10.67 |
| | Delta | (7.32) |
| 1 | Example II (Formed Bar) | 6.43 |
| 2 | Example II (Plodded/Unstamped) | 18.07 |
| | Delta | (11.64) |

*The "hardness" of the "plodder/stamped" bars is reported as Bar 2 in Table 12 for each bar tested. The Bar Hardness Test is set out herein elsewhere.

While not being bound to a theory, plodded bars with Delta's of 4 or greater is a strong indication that there is a skeletal structure in the original which is fractured or destroyed when plodded. The hard bars of the present invention will form soft, messy bars when plodded in a conventional bar process.

The bars of Example 28 bars are first formed using the above freezer process. The bars of Example II are first formed using the above-described frame bar process.

About 5–10 Kg of each bar is plodded and stamped.

The market bars are made of tallow and coconut natural soaps. The hardness of plodded SAFEGUARD® and ZEST® bars are about the same as the original bars. The IVORY® and LAVA® plodded bars (2) are slightly softer than the original bars.

On the other hand, the plodded Bar 2 of Example 28 is much softer than the original Bar 1 of Example 28. More dramatically, the plodded Bar 2 of Example II falls apart upon plodding and is too soft to stamp. Its hardness after plodding is that of a soft aqueous phase, indicating that the rigidity of the skeletal structure is essentially destroyed.

What is claimed is:

1. A personal cleansing bar composition comprising a rigid, crystalline interlocking mesh of elongated sodium soap crystals; said soap bar comprising: from about 15% to about 50% sodium fatty acid soap composed of at least about 50% saturated fatty alkyl chains having 12–24 carbon atoms of which at least about 25% of said saturated fatty alkyl chains is of a single chain length; from about 15% to about 60% water; and from about 2% to about 60% by weight of a hygroscopic synthetic surfactant wherein said hygroscopic synthetic surfactant is selected from surfactants which absorb at least about 20% of their dry weight in water at 26° C. and 80% Relative Humidity in three days.

2. A cleansing bar composition comprising at least two phases;

an aqueous phase having a penetration value of 12 mm for a 12 mm deep sample, said aqueous phase being soft or flowable at 25° C.;

a rigid crystalline phase skeleton structure comprising an interlocking, open three-dimensional mesh of neutralized mono- and/or di-carboxylic acid elongated crystals;

wherein said cleansing bar comprising said rigid crystalline phase skeleton structure and said aqueous phase has a penetration value of from zero to about 12 mm for a 25 mm deep sample of said cleansing bar;

wherein said penetration values are measured as 25° C. using a 247 gram Standard Weighted Penetrometer Probe having a conical needle attached to a 9 inch (22.9 cm) shaft, weighing 47 grams with 200 grams on top of said shaft for a total of said 247 grams, said conical needle having a 19/32 inch (1.51 cm) top and a 1/32 inch (0.08 cm) point; and wherein said neutralized carboxylic acid is selected from the group consisting of lithium and/or sodium neutralized; monocarboxylic acid and/or dicarboxylic acid; and mixtures thereof;

wherein said monocarboxylic acid has a fatty alkyl chain of from about 12 to about 24 carbon atoms;

wherein at least about 80% of said carboxylic acid has saturated alkyl chains;

wherein said rigid crystalline phase skeleton structure occupies from about 3% to about 75% of said cleansing bar by volume; and wherein said neutralized carboxylic acid comprises from over 5% to about 75% by weight of said cleansing bar; and wherein said cleansing bar contains from about 15% to about 94% water.

3. The personal cleansing bar composition of claim 1 wherein said hygroscopic synthetic surfactant is selected from the group consisting of alpha sulfo fatty acid esters; alkyl sulfates; alkyl ether carboxylates; alkyl betaines; alkyl sultaines; alkyl amine oxides; alkyl ether sulfates; and mixtures thereof.

4. The cleansing bar composition of claim 2 wherein at least 80% of said carboxylic acid has the following general formula:

$$H-(CH_2)_a-\underset{\underset{X}{|}}{CH}-(CH_2)_b-CO_2-M^+$$

wherein:

$a + b = 8$ to 20
each a, b = 0 to 20

$X = H, OR, O-\overset{\overset{O}{\|}}{C}-R, R$, or mixtures thereof $R = C_1-C_3$ alkyl, H, or mixtures thereof
M = Na, Li, or mixtures thereof.

5. The cleansing bar composition of claim 4 wherein said a+b=10–16; each of said a, b=0–16; said X=H, OR; R=H; and M=Na.

6. The cleansing bar composition of claim 2 wherein said elongated crystals are composed of fiber-like sodium fatty acid soap of which at least about 25% of said saturated fatty alkyl chains is of a single chain length; and wherein said bar contains: from about 15% to about 75% of said sodium soap; wherein said bar contains unneutralized carboxylic acid of no more than 50% by weight of said soap.

7. The cleansing bar composition of claim 6 wherein said bar contains said sodium soap and water; and from about 2% to about 60% of a synthetic surfactant selected from the group consisting of: alkyl sulfates, paraffin sulfonates, alkylglycerylether sulfonates, acyl sarcosinates, methyl acyl taurates, linear alkyl benzene sulfonates, N-acyl glutamates, alkyl glucosides, alpha sulfo fatty acid esters, acyl isethionates, alkyl sulfosuccinates, alkyl ether carboxylates, alkyl phosphate esters, ethoxylated alkyl phosphate esters, methyl glucose esters, protein condensates, alkyl amine oxides, alkyl betaines, alkyl sultaines, the alkyl ether sulfates with 1 to 12 ethoxy groups, and mixtures thereof, wherein said surfactants contain $C_8$–$C_{22}$ alkyl chains.

8. The cleansing bar composition of claim 7 wherein said synthetic surfactant is hygroscopic; said hygroscopic surfactant being defined as a surfactant which absorbs at least 20% of its dry weight in water at 26° C. and 80% Relative Humidity in three days and wherein said bar is relatively non-swelling.

9. The cleansing bar composition of claim 8 wherein said hygroscopic surfactant is selected from the group consisting of alpha sulfo fatty acid esters; alkyl sulfates; alkyl ether carboxylates; alkyl betaines; alkyl sultaines; alkyl amine oxides; alkyl ether sulfates; and mixtures thereof.

10. The cleansing bar composition of claim 7 wherein the ratio of said water to said soap is from about 1:1 to about 5:1; said water is present at a level of from about 25% to about 60%; wherein said soap has fatty alkyl chains are C14 to C22 and said soap level in said bar is from about 15% to about 35%; wherein at least about 85% of said soap alkyl chains are saturated; wherein said unneutralized carboxylic acid is from zero to about 25% by weight of said soap; and wherein said synthetic surfactant level is from about 4% to about 25% by weight of the bar and said surfactant is selected from the group consisting of: sodium acyl isethionates, sodium acyl sarcosinates, sodium alpha sulfo fatty acid esters, sodium paraffin sulfonates, sodium alkyl ether sulfates, sodium alkyl sulfates, sodium linear alkyl benzene sulfonates, alkyl betaines, alkyl sultaines, and trialkyl amine oxides.

11. The cleansing bar composition of claim 10 wherein the ratio of said water to soap ratio is from about 1.5:1 to about 2:1; said unneutralized carboxylic acid is from zero to about 17% by weight of said soap; said water level is from about 30% to about 45%; said soap fatty alkyl chain is from about $C_{14}$ to about $C_{18}$; wherein at least about 95% of said alkyl chains are saturated; said soap level is from about 15% to about 30%; and said synthetic surfactant level is from about 8% to about 16%.

12. The cleansing bar composition of claim 7 wherein said bar contains from about 0.1% to about 40% of a hydrophobic material selected from the group consisting of: microcrystalline wax, petrolatum, carnauba wax, palm wax, candelilla wax, sugarcane wax, vegetable derived triglycerides, beeswax, spermaceti, lanolin, wood wax, shellac wax, animal derived triglycerides, montar, ozokerite, ceresin, and Fischer-Tropsch wax.

13. The cleansing bar composition of claim 12 wherein said bar contains from about 2% to about 35% of said hydrophobic material selected from the group consisting of petrolatum and wax, said petrolatum and wax, and mixtures thereof having a melting point of from about 49° C. (120° F.) to about 85° C. (185° F.).

14. The cleansing bar composition of claim 13 wherein said bar comprises from about 5% to about 25% by weight of the bar of paraffin wax.

15. The cleansing bar composition of claim 7 wherein said bar contains from about 1% to about 50% of a non-volatile, water-soluble, nonionic organic material having a solubility of at least 5 parts in 10 parts of water; and wherein said water-soluble nonionic organic material is selected from the group consisting of a polyol of the structure:

$$R_1-O(CH_2-\underset{\underset{R_2}{|}}{C}HO)_nH$$

where $R_1=H$, $C_1$–$C_4$ alkyl; $R_2=H$, $CH_3$; and $n=1$–200; $C_2$–$C_{10}$ alkane diols; sorbitol; glycerine; sugars; sugar derivatives; urea; and ethanol amines of the general structure $(HOCH_2CH_2)_xNH_y$ where $x=1$–3; $y=0$–2; and $x+y=3$, and mixtures thereof.

16. The cleansing bar composition of claim 15 wherein said bar contains from about 2% to about 40% of said non-volatile, water-soluble, non-ionic organic material.

17. The cleansing bar composition of claim 16 wherein said non-volatile, water-soluble, nonionic organic material comprises from about 5% to about 20% by weight of the bar; and wherein said organic material is selected from the group consisting of: propylene glycol, glycerine, sucrose, and urea, and mixtures thereof.

18. The cleansing bar composition of claim 7 wherein said bar contains said sodium soap, said water, and said synthetic surfactant, and from about 0.1% to about 70% of other ingredients selected from the group consisting of:

from about 1% to about 10% potassium soap;
from about 1% to about 35% magnesium soap;
from about 1% to about 35% calcium soap;
from about 1% to about 15% triethanolamine soap;
from about 1% to about 60% of impalpable water-insoluble materials selected from the group consisting of calcium carbonate and talc;
from about 0.1% to about 20% of a polymeric skin feel aid;
from about 0.5% to about 25% of aluminosilicate clay and/or other clays; wherein said aluminosilicates and clays are selected from the group consisting of zeolites, kaolin, kaolinite, montmorillonite, attapulgite, illite, bentonite, halloysite, and calcined clays;
from about 1% to about 50% of salt and salt hydrates; and mixtures thereof; and wherein said salt and salt hydrate have a cation selected from the group consisting of: sodium, potassium, magnesium, calcium, aluminum, lithium, ammonium, monoethanol ammonium, diethanolammonium, and triethanolamine; and wherein said salt and salt hydrate have an anion selected from the group consisting of: chloride, bromide, sulfate, metasilicate, orthophosphate, pyrophosphate, polyphosphate, metaborate, tetraborate, carbonate, bicarbonate, hydrogen phosphate, methyl sulfate, and mono- and polycarboxylate of 6 carbon atoms or less.

19. The cleansing bar composition of claim 2 wherein said elongated crystals contain platelets and wherein said soap consists of lithium neutralized monocarboxylic acid.

20. The cleansing bar composition of claim 2 wherein said elongated crystals are fiber-like and wherein said neutralized dicarboxylic acid is the disodium salt of dodecanedioic acid and wherein said neutralized dicarboxylic acid comprises from about 20% to about 70% by weight of said bar.

21. The bar composition of claim 1 wherein said bar contains from about 0.5% to about 40% of salts and/or salt hydrates selected from the group consisting of: sodium chloride, sodium sulfate, disodium hydrogen phosphate, sodium pyrophosphate, sodium tetraborate, sodium acetate, sodium citrate, and other compatible salts of inorganic acids and short chain organic acids.

* * * * *